US010923036B2

(12) United States Patent
Lee

(10) Patent No.: US 10,923,036 B2
(45) Date of Patent: Feb. 16, 2021

(54) DISPLAY PANEL AND ELECTROLUMINESCENCE DISPLAY USING THE SAME

(71) Applicant: LG DISPLAY CO., LTD., Seoul (KR)

(72) Inventor: Youngjang Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 273 days.

(21) Appl. No.: 15/665,871

(22) Filed: Aug. 1, 2017

(65) Prior Publication Data

US 2018/0151125 A1 May 31, 2018

(30) Foreign Application Priority Data

Nov. 29, 2016 (KR) ..... 10-2016-0160279

(51) Int. Cl.
*G09G 3/3266* (2016.01)
*G09G 3/3233* (2016.01)
*G09G 3/3275* (2016.01)

(52) U.S. Cl.
CPC ..... *G09G 3/3266* (2013.01); *G09G 3/3233* (2013.01); *G09G 3/3275* (2013.01); *G09G 2300/0819* (2013.01); *G09G 2300/0861* (2013.01); *G09G 2300/0866* (2013.01); *G09G 2310/0286* (2013.01); *G09G 2310/08* (2013.01); *G09G 2320/0247* (2013.01); *G09G 2320/045* (2013.01); *G09G 2354/00* (2013.01)

(58) Field of Classification Search
CPC .. G09G 3/3266; G09G 3/3233; G09G 3/3275; G09G 2310/0286
See application file for complete search history.

(56) References Cited

U.S. PATENT DOCUMENTS 7,528,808 B2 * 5/2009 Tam ..... G09G 3/3233 345/76
2003/0197472 A1 * 10/2003 Kanauchi ..... G09G 3/3275 315/169.1

(Continued)

FOREIGN PATENT DOCUMENTS

CN 1674739 A 9/2005
CN 103854585 A 6/2014

(Continued)

*Primary Examiner* — Nitin Patel
*Assistant Examiner* — Robert M Stone
(74) *Attorney, Agent, or Firm* — Birch, Stewart, Kolasch & Birch, LLP

(57) ABSTRACT

A display panel and an electroluminescence display using the same are discussed. The display panel includes pixels in which data lines and gate lines are crossed and which are arranged in a matrix form, and a gate driver configured to supply a gate pulse to the gate lines. Each pixel circuit of the pixels includes one or more n-type transistors and two or more p-type transistors. A gate driver of the display panel includes a first gate driving circuit configured to supply a first gate signal to an n-type transistor of the pixel circuit using a plurality of n-type transistors, a second gate driving circuit configured to supply a second gate signal to one of the p-type transistors of the pixel circuit using a plurality of p-type transistors, and a third gate driving circuit configured to supply a third gate signal to the other one of the p-type transistors of the pixel circuit using a plurality of n-type transistors.

12 Claims, 17 Drawing Sheets

(56) References Cited

U.S. PATENT DOCUMENTS

2005/0001805 A1* 1/2005 Jeon ..... G11C 19/28 345/92
2005/0212444 A1 9/2005 Lee et al.
2007/0103405 A1* 5/2007 Kwak ..... G09G 3/3233 345/76
2007/0115244 A1* 5/2007 Shin ..... G09G 3/3266 345/100
2007/0164967 A1* 7/2007 Osame ..... G09G 3/3233 345/98
2007/0229433 A1* 10/2007 Jang ..... G09G 3/3696 345/96
2007/0296682 A1* 12/2007 Hwang ..... G11C 19/00 345/100
2008/0136756 A1* 6/2008 Yeo ..... G09G 3/3677 345/87
2008/0143706 A1 6/2008 Kim
2009/0146987 A1* 6/2009 Kim ..... G09G 3/3233 345/212
2010/0033417 A1* 2/2010 Shu ..... G09G 3/3677 345/98
2011/0057917 A1 3/2011 Ryu et al.
2012/0044225 A1* 2/2012 Kim ..... G09G 3/3614 345/209
2012/0075280 A1* 3/2012 Liu ..... G09G 3/3696 345/212
2012/0169693 A1* 7/2012 Tsai ..... G09G 3/3233 345/211
2012/0218245 A1* 8/2012 Morii ..... G09G 3/3677 345/211
2014/0015770 A1* 1/2014 Lee ..... G09G 3/3677 345/173
2014/0043373 A1* 2/2014 Kim ..... G09G 5/00 345/690
2014/0104248 A1* 4/2014 Won ..... G09G 5/00 345/204
2015/0049126 A1* 2/2015 Jung ..... G09G 3/3233 345/690
2015/0243220 A1* 8/2015 Kim ..... H01L 27/1225 345/215
2015/0269900 A1* 9/2015 Iwamoto ..... G09G 3/3688 345/100
2015/0294635 A1* 10/2015 Ryu ..... G09G 3/3677 345/99
2016/0005359 A1 1/2016 Kwon et al.
2016/0140904 A1* 5/2016 Wu ..... G09G 3/3233 345/78
2016/0240565 A1* 8/2016 Kim ..... H01L 27/1251
2017/0018220 A1* 1/2017 Takahara ..... G09G 3/3233
2017/0194411 A1* 7/2017 Park ..... H01L 51/5253
2017/0365220 A1* 12/2017 Huang ..... G11C 19/28
2018/0144684 A1* 5/2018 Jeon ..... G09G 3/3233

FOREIGN PATENT DOCUMENTS

JP WO2015136588 A1 * 4/2017 ..... G09G 3/3233
KR 10-2015-0059604 A 6/2015
KR 10-2015-0077896 A 7/2015
KR 10-2017-0071631 A 6/2017
WO WO 2015/136588 A1 9/2015

* cited by examiner

DISPLAY PANEL AND ELECTROLUMINESCENCE DISPLAY USING THE SAME

CROSS-REFERENCE TO RELATED APPLICATION

This application claims the priority benefit of Korean Patent Application No. 10-2016-0160279 filed on Nov. 29, 2016, the entire contents of which is incorporated herein by reference for all purposes as if fully set forth herein.

BACKGROUND OF THE INVENTION

Field of the Invention

The present disclosure relates to a display panel in which gate driving circuits are arranged on the same substrate together with circuit elements of an active area in which an input image is displayed, and relates to an electroluminescence display using the same.

Discussion of the Related Art

A flat panel display device includes a liquid crystal display (LCD), an electroluminescence display, a field emission display (FED), a plasma display panel (PDP), and the like.

An electroluminescence display device is divided into an inorganic light emitting display device and an organic light emitting display device depending on materials of a light emitting layer. An active matrix organic light emitting diode display includes organic light emitting diodes (OLEDs) capable of emitting light by themselves and has many advantages, such as a fast response time, a high emission efficiency, a high luminance, a wide viewing angle, and the like.

An OLED of the organic light emitting display device includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When a power voltage is applied to the anode electrode and the cathode electrode, holes passing through the hole transport layer HTL and electrons passing through the electron transport layer ETL move to the emission layer EML and form excitons. As a result, the emission layer EML generates visible light.

A driving circuit of the flat panel display includes a data driving circuit for supplying a data signal to data lines, a gate driving circuit for supplying a gate signal (or a scan signal) to gate lines (or scan lines). The gate driving circuit may be formed directly on the same substrate together with a thin film transistor (TFT) array of an active area constituting a screen. Hereinafter, the gate driving circuit formed directly on the substrate of the display panel will be referred to as a GIP circuit. The GIP circuit includes a shift register in which stages are connected in a cascade connection. The GIP circuit receives a start pulse or a carry signal received from a previous stage as a start pulse, and generates an output when a clock is input. The GIP circuit can sequentially supply the gate signal to the gate lines by shifting the output in a shift clock timing.

Each of pixels of the flat panel display is divided into a plurality of sub-pixels having different colors for color implementation. Each of the sub-pixels includes a transistor used as a switching element or a driving element. Such a transistor can be implemented as a TFT. The GIP circuit supplies a gate signal to a gate of the transistor formed in each of the pixels to turn on/off the transistor.

The organic light emitting display includes a pixel circuit disposed for each of the sub-pixels. Each of the pixel circuits includes a plurality of transistors. Gate signals having different waveforms may be applied to these transistors. A GIP circuit is required as many as the number of gate signals applied to the pixel circuit. Each of the GIP circuits includes a shift register, and wirings for transmitting a start pulse, a shift clock, and the like for controlling the shift register are required.

Two or more gate signals having different phases may be applied to the pixel circuit. In an instance of generating a gate signal whose phase is inverted compared to other gate signals, an inverter circuit is connected to an output node of the GIP circuit, and the inverter circuit is used to invert an output signal of the GIP circuit. For example, when a scan signal and an emission signal (hereinafter, referred to as gate signal(s)) are applied to the pixel circuit, the GIP circuit includes a first GIP circuit for generating the scan signal, a second GIP circuit for outputting the gate signal, and an inverter. The GIP circuit is disposed in a bezel area outside the active area (A/A) where an image is displayed on the substrate of the display panel. Therefore, when the GIP circuit is large, a narrow bezel cannot be realized because the bezel area becomes large on the display panel.

SUMMARY OF THE INVENTION

The invention provides a display panel capable of reducing a size of a GIP circuit, and an electroluminescence display using the same.

In one aspect, there is provided a display panel including pixels in which data lines and gate lines are crossed and which are arranged in a matrix form and a gate driver configured to supply a gate pulse to the gate lines. Each pixel circuit of the pixels includes one or more n-type transistors and two or more p-type transistors. The gate driver includes a first gate driving circuit configured to supply a first gate signal to an n-type transistor of the pixel circuit using a plurality of n-type transistors, a second gate driving circuit configured to supply a second gate signal to one of the p-type transistors of the pixel circuit using a plurality of p-type transistors, and a third gate driving circuit configured to supply a third gate signal to the other one of the p-type transistors of the pixel circuit using a plurality of n-type transistors.

Each of the n-type transistors may include an oxide thin film transistor (TFT).

Each of the p-type transistors may include a low temperature polysilicon (LTPS) TFT.

Each of the first, second and third gate driving circuits may include a shift register which receives a start pulse and shift clocks and shifts an output signal. The first and third gate driving circuits may share a start pulse.

Each of the first, second and third gate driving circuits may include a shift register which receives a start pulse and shift clocks and shifts an output signal. The first and third gate driving circuits may share a part of a start pulse and shift clocks.

In another aspect, there is provided a display panel including pixels in which data lines and gate lines are crossed, and each pixel circuit of the pixels including an n-type transistor and a p-type transistor, a first gate driving circuit configured to supply a first gate signal to the n-type transistor of the pixel circuit using a plurality of n-type transistors, and a second gate driving circuit configured to supply a second gate signal to the p-type transistor of the pixel circuit using a plurality of n-type transistors. The first and second gate driving circuits share a part of input signals.

An electroluminescence display of the invention includes the display panel.

In another aspect, there is provided an electroluminescence display comprising an active area including pixels in which data lines and gate lines are crossed and which are arranged in a matrix form; a data driver configured to supply a data signal of an input image to the data lines; and a gate driver configured to supply a gate pulse to the gate lines, wherein each pixel circuit of the pixels includes one or more n-type transistors and two or more p-type transistors, wherein the gate driver including: a first gate driving circuit configured to supply a first gate signal to an n-type transistor of the pixel circuit using a plurality of n-type transistors; a second gate driving circuit configured to supply a second gate signal to one of the p-type transistors of the pixel circuit using a plurality of p-type transistors; and a third gate driving circuit configured to supply a third gate signal to the other one of the p-type transistors of the pixel circuit using a plurality of n-type transistors.

In another aspect, there is provided an electroluminescence display comprising an active area including pixels in which data lines and gate lines are crossed and which are arranged in a matrix form, and each pixel circuit of the pixels including an n-type transistor and a p-type transistor; a data driver configured to supply a data signal of an input image to the data lines; a first gate driving circuit configured to supply a first gate signal to the n-type transistor of the pixel circuit using a plurality of n-type transistors; and a second gate driving circuit configured to supply a second gate signal to the p-type transistors of the pixel circuit using a plurality of n-type transistors, wherein the first and second gate driving circuits share a part of input signals.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
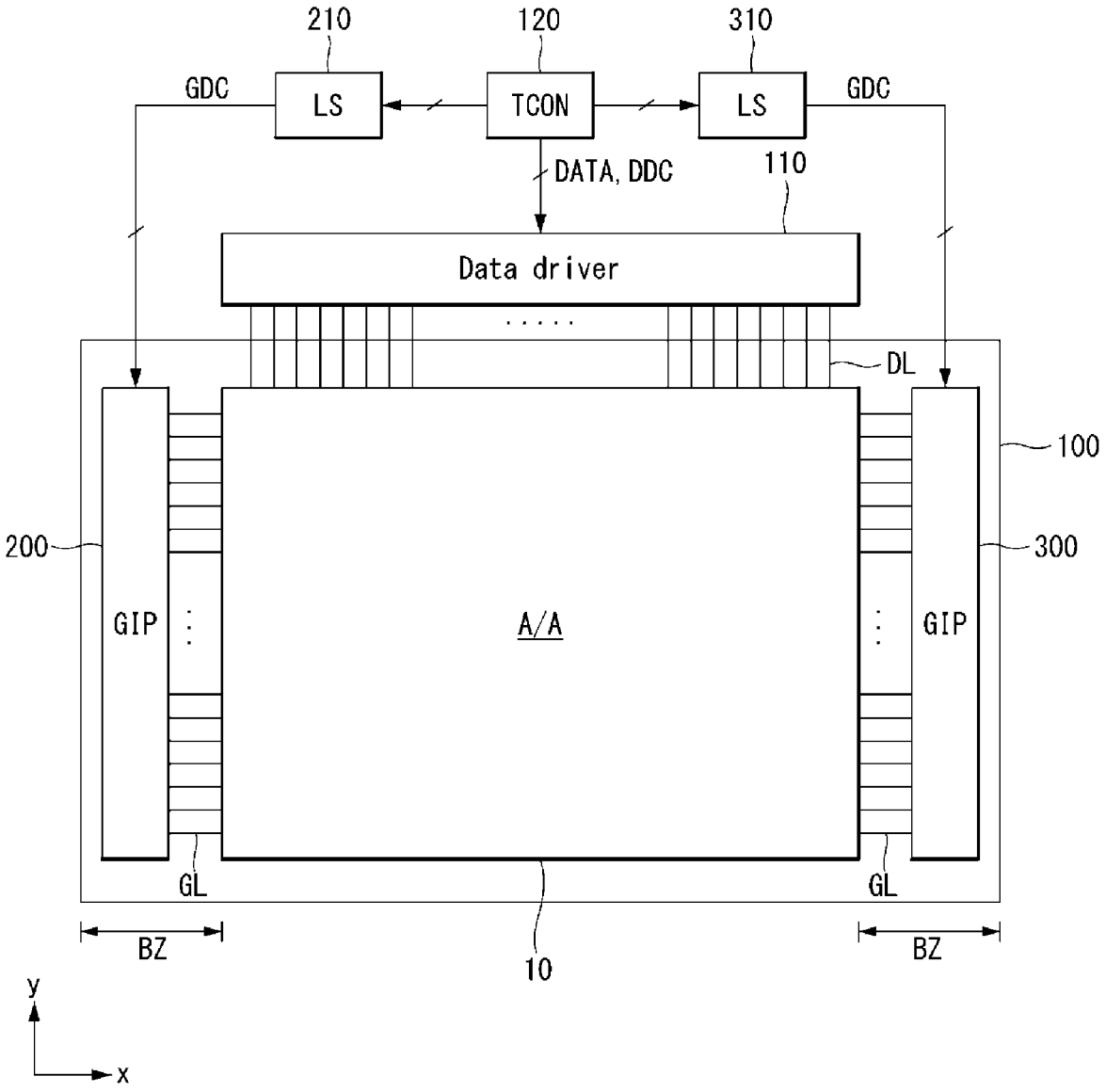
FIG. 1 is a block diagram illustrating an electroluminescence display according to an embodiment of the invention.

Advantages and features of the present disclosure and methods for accomplishing the same will become apparent with reference to the embodiments described in detail below with reference to the accompanying drawings. However, the present disclosure is not limited to embodiments disclosed below, and may be implemented in various forms. These embodiments are provided so that the present disclosure will be exhaustively and completely described, and will fully convey the scope of the present disclosure to those skilled in the art to which the present disclosure pertains. The present disclosure is only defined by the scope of the claims.

Shapes, sizes, ratios, angles, number, and the like illustrated in the drawings for describing embodiments of the present disclosure are merely exemplary, and the present disclosure is not limited thereto. Like reference numerals designate like elements throughout the description. In the following description, when a detailed description of well-known functions or configurations related to this document is determined to unnecessarily cloud a gist of the invention, the detailed description thereof will be omitted.

In the present disclosure, when the terms "include", "have", "comprise", etc. are used, other components may be added unless "~ only" is used. A singular expression can include a plural expression as long as it does not have an apparently different meaning in context.

In the explanation of components, even if there is no separate description, it is interpreted as including an error range.

In the description of position relationship, when a structure is described as being positioned "on or above", "under or below", "next to" another structure, this description should be construed as including a case in which the structures contact each other as well as a case in which a third structure is disposed therebetween.

The terms "first", "second", etc. may be used to describe various components, but the components are not limited by such terms.

The features of various embodiments of the present disclosure can be partially combined or entirely combined with each other, and can be technically interlocking-driven in various ways. The embodiments can be independently implemented, or can be implemented in conjunction with each other.

Each of a GIP circuit and a pixel circuit of the invention includes an oxide TFT including an oxide semiconductor and an LTPS TFT including a low temperature polysilicon (LTPS). The oxide TFT may be implemented as an n-type TFT (NMOS), and the LTPS TFT may be implemented as a p-type TFT (PMOS).

Each of the GIP circuit and the pixel circuit of the invention includes an n-type TFT (NMOS) and a p-type TFT (PMOS). A TFT is a three-electrode element including a gate, a source, and a drain. The source is an electrode that supplies carriers to the transistor. In the TFT, the carriers start to flow from the source. The drain is an electrode in which the carriers exit from the TFT to outside. The carriers in the TFT flow from the source to the drain. In an instance of the n-type TFT (NMOS), since a carrier is an electron, a source voltage has a voltage lower than a drain voltage so that the electron can flow from the source to the drain. In the n-type TFT, a direction of a current flows from the drain to the source. In an instance of the p-type TFT (PMOS), since a carrier is a hole, a source voltage is higher than a drain voltage so that the hole can flow from the source to the drain. In the p-type TFT, a current flows from the source to the drain because the hole flows from the source to the drain. It should be noted that the source and the drain of the TFT are not fixed. For example, the source and the drain may be changed depending on an applied voltage. Therefore, the invention is not limited by the source and the drain of the TFT. In the following description, the source and the drain of the TFT will be referred to as a first electrode and a second electrode, respectively.

A gate signal output from the GIP circuit swings between a gate on voltage and a gate off voltage. The gate on voltage is set to a voltage higher than a threshold voltage of the TFT, and the gate off voltage is set to a voltage lower than the threshold voltage of the TFT. The TFT is turned on in response to the gate on voltage, while the TFT is turned off in response to the gate off voltage. In an instance of the n-type TFT, the gate on voltage may be a gate high voltage (VGH) and the gate off voltage may be a gate low voltage (VGL). In an instance of the p-type TFT, the gate on voltage may be the gate low voltage (VGL) and the gate off voltage may be the gate high voltage (VGH).

Hereinafter, various embodiments of the invention will be described in detail with reference to the accompanying drawings. In the following embodiments, an electroluminescence display device will be described focusing on an organic light emitting display device including an organic light emitting material. However, it should be noted that the technical sprit of the invention is not limited to the organic light emitting display device, but can be applied to an inorganic light emitting display device including an inorganic light emitting material.

Figure 2:
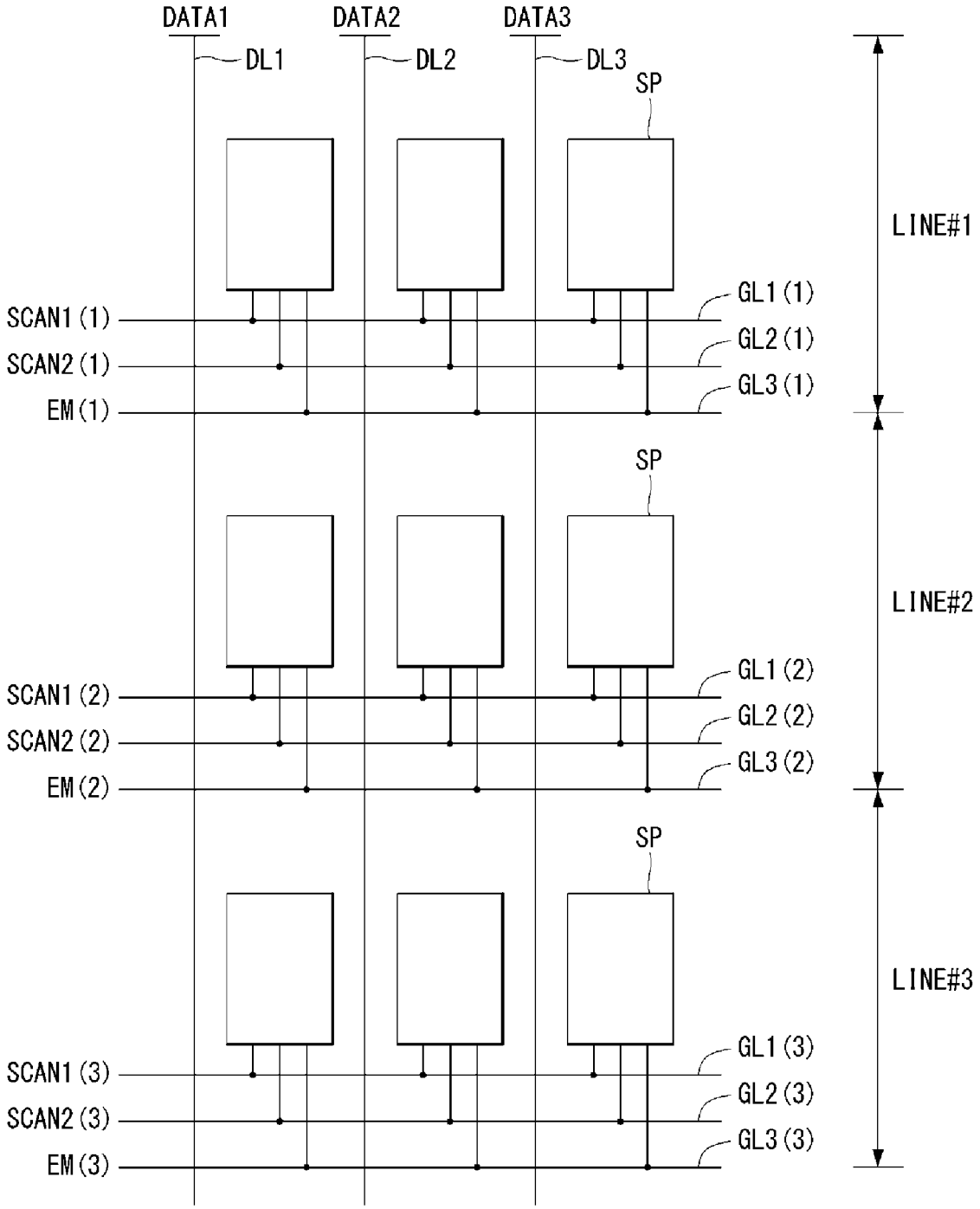
FIG. 2 is a plan view schematically illustrating a part of an active area shown in FIG. 1.
Figure 3:
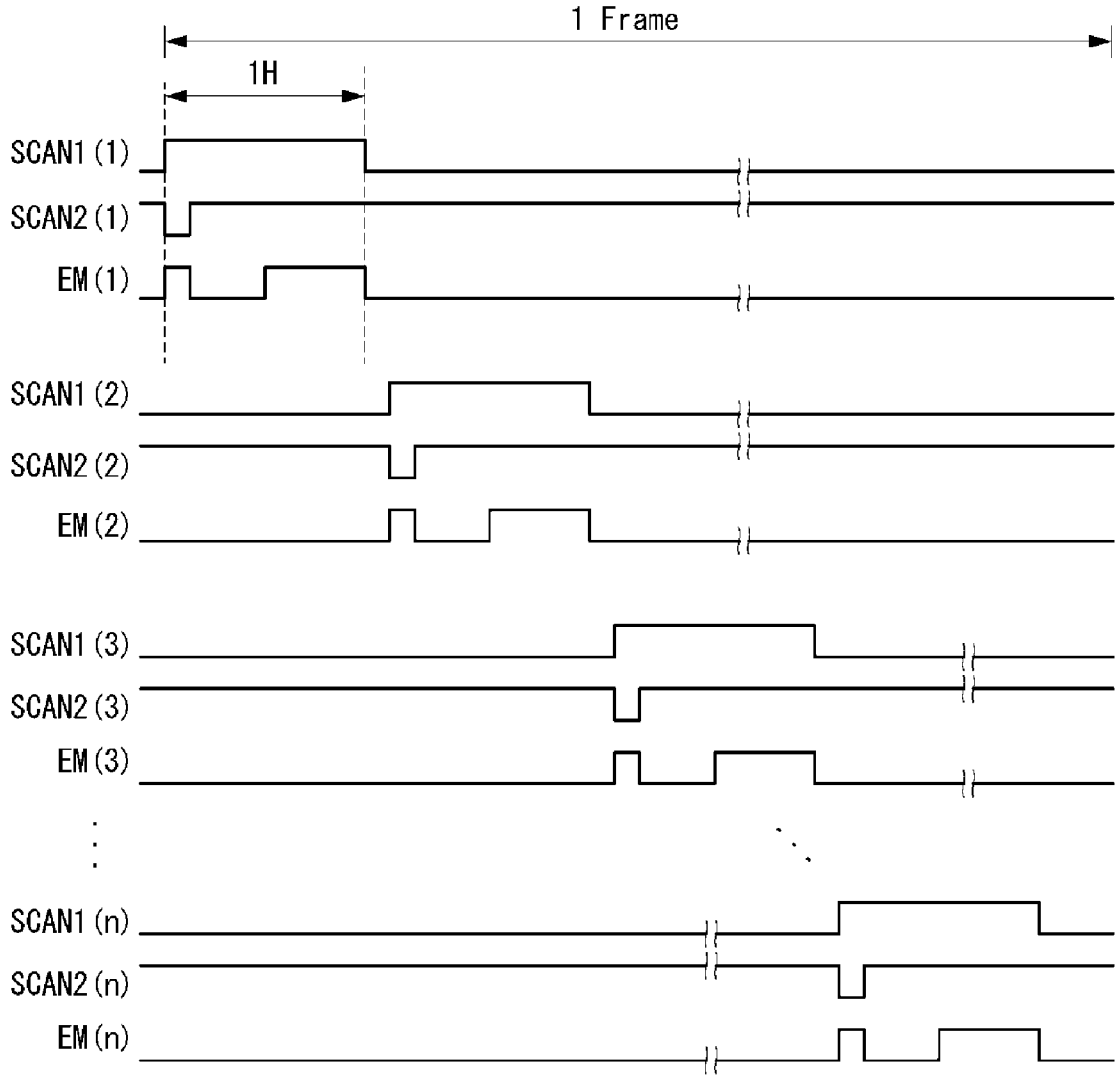
FIG. 3 is a waveform diagram illustrating an example of a gate signal applied to n lines of a display panel according to an embodiment of the invention.
Figure 4:
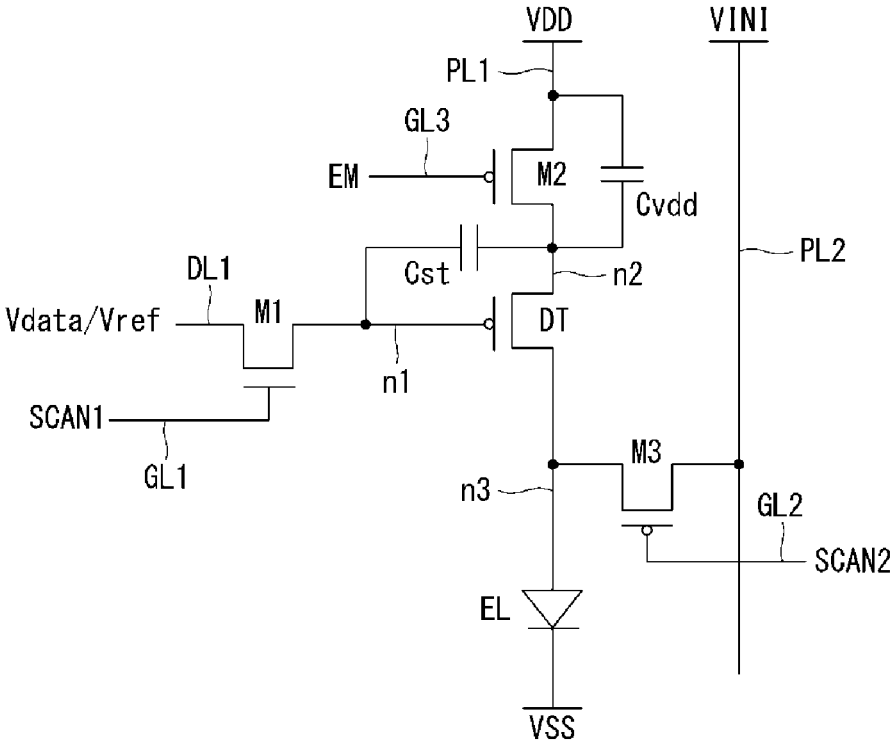
FIG. 4 is a circuit diagram illustrating an example of a pixel circuit according to an embodiment of the invention.

FIG. 1 is a block diagram illustrating an electroluminescence display according to an embodiment of the invention. FIG. 2 is a plan view schematically illustrating a part of an active area shown in FIG. 1. FIG. 3 is a waveform diagram illustrating an example of a gate signal applied to n lines of a display panel of the electroluminescence display in FIG. 1. FIG. 4 is a circuit diagram illustrating an example of a pixel circuit in the electroluminescence display in FIG. 1. All components of the electroluminescence display according to all embodiments of the invention are operatively coupled and configured.

Referring to FIGS. 1 to 4, an electroluminescence display according to an embodiment of the invention includes a display panel 100 and a display panel driving circuit.

The display panel 100 includes an active area A/A for displaying an input image. A pixel array is arranged in the active area A/A. The pixel array includes a plurality of data lines DL, a plurality of gate lines GL intersecting with the data lines DL, and pixels arranged in a matrix form.

Each of the pixels may be divided into a red sub-pixel, a green sub-pixel, and a blue sub-pixel for color implementation. Each of the pixels may further include a white sub-pixel. Each of the sub-pixels SP includes a pixel circuit. The pixel circuit includes a light emitting element, a plurality of TFTs, and a capacitor. The pixel circuit is connected to the data line DL and the gate line GL.

The pixel circuit of the invention includes one or more n-type transistors and two or more p-type transistors, as in an example of FIG. 4.

The oxide TFT may be implemented as an n-type TFT (NMOS). The oxide TFT has a small leakage current in an off state. A low temperature polysilicon (LTPS) TFT may be implemented as a p-type TFT (PMOS). The LTPS TFT has high carrier mobility and therefore has advantages in driving efficiency and power consumption. It should be noted that the pixel circuit may be implemented with the circuit shown in FIG. 4, but is not limited thereto.

In the instance of the pixel circuit shown in FIG. 4, gate signals such as a first gate signal SCAN1, a second gate signal SCAN2, and a third gate signal EM are applied to each of the sub-pixels SP. For each line LINE #1 to LINE #3 of the display panel, the gate lines including a first gate line GL1 to which the first gate signal SCAN1 is supplied, a second gate line GL2 to which the second gate signal SCAN2 is supplied, and a third gate line GL3 to which the third gate signal EM is supplied are connected to the sub-pixels SP.

In FIGS. 2 and 3, SCAN1 (1), SCAN2 (1), and EM (1) are gate signals applied to sub-pixels of a first line LINE #1 through the gate lines GL1 (1), GL2 (1), and GL3 (1). SCAN1 (2), SCAN2 (2), and EM (2) are gate signals applied to sub-pixels of a second line LINE #2 through the gate lines GL1 (2), GL2 (2), and GL3 (2). SCAN1 (3), SCAN2 (3), and EM (3) are gate signals applied to sub-pixels of a third line LINE #3 through the gate lines GL1 (3), GL2 (3), and GL3 (3). In FIG. 2, DATA1 to DATA3 are data signals supplied to the sub-pixels SP through the data lines DL1 to DL3.

As shown in FIG. 4, the display panel 100 further includes a first power line PL1 for supplying a pixel driving voltage VDD to the sub-pixels SP, a second power line PL2 for supplying an initialization voltage VINI to the sub-pixels SP, and a VSS electrode for supplying a low potential power supply voltage VSS to the sub-pixels SP, and the like. The power lines are connected to a power supply circuit.

Touch sensors may be disposed on the display panel 100. A touch input may be sensed using separate touch sensors or may be sensed through the pixels. The touch sensors may be disposed on a screen of the display panel as an on-cell type or an add-on type, or may be implemented as in-cell type touch sensors embedded in the pixel array.

The display panel driving circuit writes data of the input image to the pixels of the display panel 100 under a control of a timing controller (TCON) 120. The display panel driving circuit includes a data driver 110 and GIP circuits 200 and 300 driven under the control of the timing controller 120. The display panel 100 may be provided with touch sensors. In this instance, the display panel driving circuit further includes a touch sensor driving unit.

The display panel driving circuit may operate in a low refresh mode. When the input image does not change by a preset number of frames, the low refresh mode may be set to reduce power consumption of the display device. In other words, the low refresh mode can reduce a refresh rate of the pixels when a still image is input for a predetermined time or more, thereby reducing the power consumption by controlling a data writing period of the pixels to be long. The low refresh mode is not limited to when a still image is input. For example, when the display device operates in a standby mode or a user command or an input image is not input to the display panel driving circuit for a predetermined time or more, the display panel driving circuit may operate in the low refresh mode.

The data driver 110 converts digital data DATA of the input image received from the timing controller 120 every frame in the normal driving mode into a data voltage, and supplies the data voltage to the data lines DL. The data driver 110 outputs the data voltage using a digital to analog converter (hereinafter, referred to as DAC) that converts the digital data into a gamma compensation voltage. A driving frequency of the data driver 110 is lowered under the control of the timing controller 120 in the low refresh mode. For example, the data driver 110 outputs the data voltage of the input image every frame period in the normal driving mode. The data driver 110 outputs the data voltage of the input image in some frame periods within the low refresh mode period and does not generate the output in the remaining frame periods. Therefore, the driving frequency and power consumption of the data driver 110 in the low refresh mode are significantly lower than those in a normal driving mode.

A multiplexer may be disposed between the data driver 110 and the data lines DL of the display panel 100. The multiplexer can reduce the number of channels of the data driver 110 by distributing the data voltages output through one channel in the data driver 110 to N (N is a positive integer equal to or greater than two) data lines DL. The multiplexer can be omitted depending on resolution and usage of the display device.

The GIP circuits 200 and 300 output the gate signals SCAN 1, SCAN 2 and EM under the control of the timing controller 120 to select pixels to which the data voltages are charged through the gate lines GL. The GIP circuits 200 and 300 can sequentially supply signals to the gate lines GL by shifting the gate signals SCAN1, SCAN2 and EM using a shift register.

Figure 6:
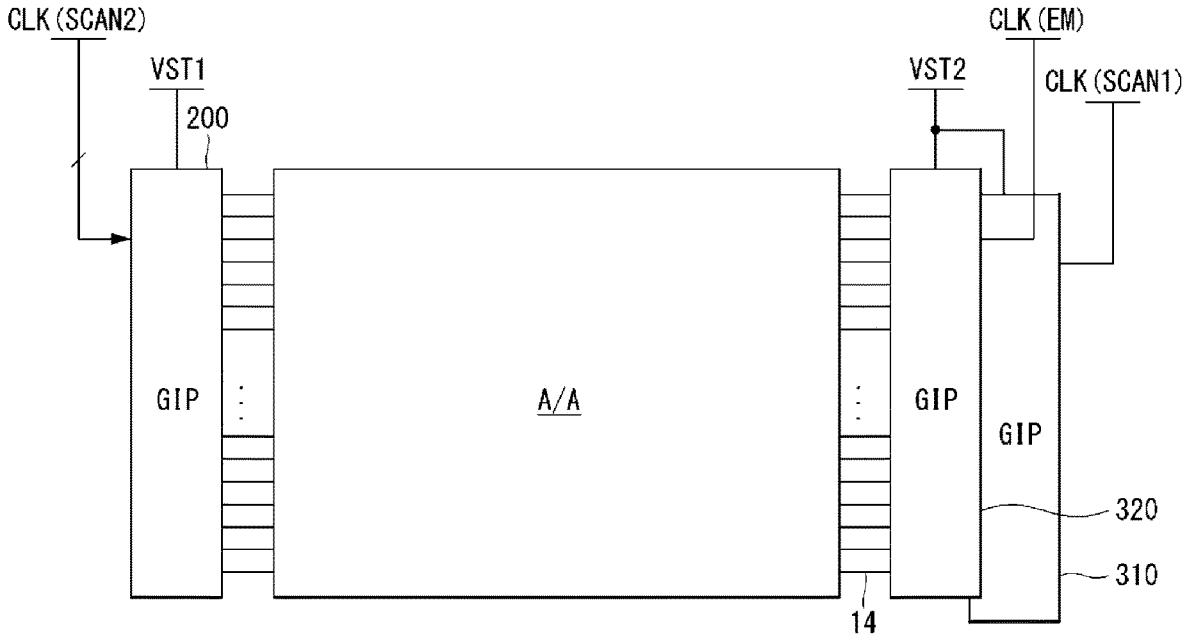
FIG. 6 is a diagram schematically illustrating an example in which a second GIP circuit is composed of two GIP circuits sharing a start pulse according to an embodiment of the invention.

The GIP circuits 200 and 300 include a first GIP circuit 200 and a second GIP circuit 300. The first GIP circuit 200 is implemented as p-type TFTs and outputs the second gate signal SCAN2. The second GIP circuit 300 is implemented as n-type TFTs and outputs the first gate signal SCAN1 and the third gate signal EM. The first and second GIP circuits 200 and 300 may be separated across the active area A/A. As shown in FIG. 6, the first GIP circuit 200 may be disposed on one side bezel region BZ of the display panel 100. The second GIP circuit 300 may be disposed on the other side bezel region BZ of the display panel 100. In an instance of a model without a bezel, the first and second GIP circuits 200 and 300 may be distributed in the active area A/A. It should be noted that the arrangement of the first and second GIP circuits 200 and 300 is not limited to FIG. 6.

In the low refresh mode, the gate drivers 200 and 300 have a driving frequency lowered under the control of the timing controller 120. Therefore, the driving frequency and power consumption of the gate drivers 200 and 300 are significantly lower than in the normal driving mode.

The timing controller 120 receives digital video data DATA of an input video from a host system and timing signals synchronized with the digital video data DATA. The timing signals include a vertical synchronization signal Vsync, a horizontal synchronization signal Hsync, a clock signal DCLK, and a data enable signal DE. The host system may be any one of a television (TV) system, a set-top box, a navigation system, a personal computer (PC), a home theater system, a phone system, and a wearable device system.

The timing controller 120 includes a low refresh control module that lowers a driving frequency of the display panel driving circuits 110, 200, and 300. It should be noted that the low refresh mode as described above is not limited to still images.

The timing controller 120 multiplies an input frame frequency by i in the normal driving mode and can control operation timings of the display panel driving circuits 110, 200 and 300 at a frame frequency of the input frame frequency×i (i is a positive integer larger than 0) Hz. The input frame frequency is 60 Hz in the National Television Standards Committee (NTSC) system and 50 Hz in the PAL (Phase-Alternating Line) system.

The timing controller 120 lowers the driving frequency of the display panel driving circuits 110, 200, and 300 in the low refresh mode. For example, the timing controller 120 may lower the driving frequency of the display panel driving circuit to 1 Hz so that data is written once to pixels per second (sec). The frequency of the low refresh mode is not limited to 1 Hz. As a result, the pixels of the display panel 100 maintain an already charged data voltage without charging a new data voltage for most of the time in the low refresh mode.

The timing controller 120 generates a data timing control signal DDC for controlling the operation timing of the data driver 110 and a gate timing control signal GDC for controlling the operation timing of the GIP circuits 200 and 300 based on the timing signals Vsync, Hsync, and DE received from the host system. A voltage level of the gate timing control signal GDC output from the timing controller 120 is converted through level shifters (LS) 210 and 310 and supplied to the GIP circuits 200 and 300. The level shifters 210 and 310 convert a low level voltage of the gate timing control signal GDC into a gate low voltage VGL and convert a high level voltage of the gate timing control signal GDC into a gate high voltage VGH.

The gate timing control signal GDC includes a start pulse (Gate Start Pulse), a shift clock (Gate Shift Clock), and the like. The start pulse is generated once every frame period at the beginning of the frame period and input to the GIP circuits 200 and 300. The gate start pulse VST controls a start timing of the GIP circuits 200 and 300 every frame period. The shift clock controls a shift timing of the gate signal output from the GIP circuits 200 and 300.

Figure 5:
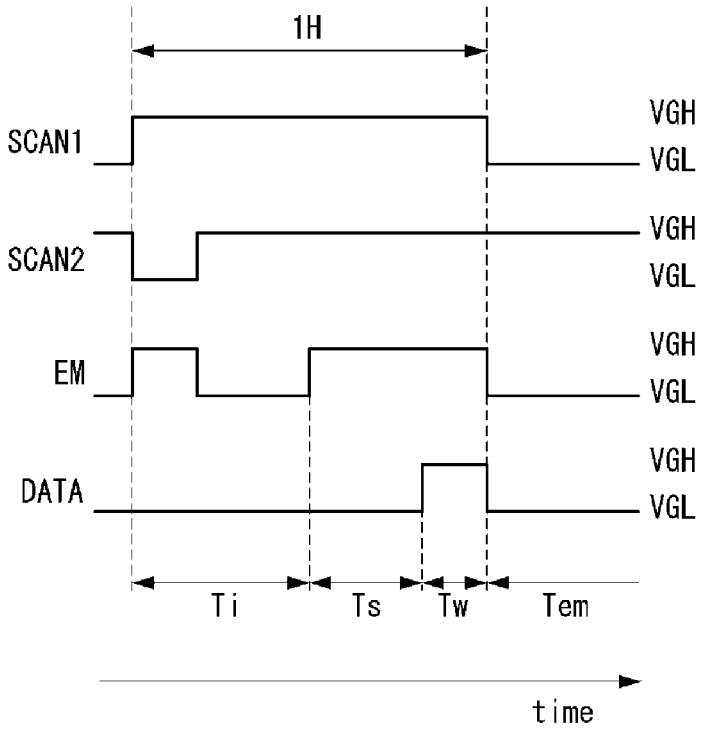
FIG. 5 is a waveform diagram illustrating input signals of the pixel circuit shown in FIG. 4.

FIG. 4 is a circuit diagram illustrating an example of a pixel circuit. FIG. 5 is a waveform diagram illustrating input signals of the pixel circuit shown in FIG. 4.

Referring to FIGS. 4 and 5, the pixel circuit includes a light emitting element EL, a plurality of thin film transistors (TFTs) M1 to M3, DT, and capacitors Cst and Cvdd.

The light emitting element EL may be implemented as an OLED. The OLED emits light with an amount of current controlled by a fourth TFT DT depending on a data voltage Vdata. A current path of the OLED is switched by a second TFT M2. The OLED includes an organic compound layer formed between an anode and a cathode. The organic compound layer may include a hole injection layer (HIL), a hole transport layer (HTL), an emission layer (EML), an electron transport layer (ETL), and an electron injection layer (EIL). However, it is not limited thereto. The anode of the OLED is connected to a third node n3, and the cathode is connected to a VSS electrode to which a low potential supply voltage VSS is supplied.

A first capacitor Cst is connected between a first node n1 and a second node n2. A second capacitor Cvdd is connected between a first power line PL1 to which a pixel driving voltage VDD is supplied and the second node n2. The pixel driving voltage VDD is supplied to the sub-pixels SP through the first power line PL1.

Since a first TFT M1 is a switching element having a long off period, the first TFT M1 may be implemented as an n-type oxide TFT having a small leakage current in the off state. When the first TFT M1 is implemented as an oxide TFT, since the leakage current can be reduced to reduce the power consumption, and a voltage drop of the pixel due to the leakage current can be prevented, flicker prevention effect can be enhanced. Second, third and fourth TFTs M2, M3, and DT may be implemented as a p-type LTPS TFT. When the fourth TFT DT used as a driving element and the second TFT M2 having a short off period are implemented as the LTPS TFT, since the charge mobility is high, an amount of current flowing through the OLED can be increased to increase the driving efficiency and improve the power consumption.

The first gate signal SCAN1, the second gate signal SCAN2 and the third gate signal EM are applied to each of the sub-pixels during one horizontal period 1H, and define on/off timings of the switching elements M1, M2 and M3. Since the first TFT M1 is implemented as the n-type oxide TFT, a gate on voltage of the first gate signal SCAN1 is set to the gate high voltage VGH and a gate off voltage thereof is set to the gate low voltage VGL. Since the second to fourth TFTs M2, M3, and DT are implemented as the p-type LTPS TFTs, gate on voltages of the second and third gate signals SCAN2 and EM are set to the gate low voltage VGL and gate off voltages thereof are set to the gate high voltage VGH.

The first gate signal SCAN1 is maintained at the gate on voltage VGH for one horizontal period 1H, and then is remained at the gate off voltage VGL for the remaining frame period. The second gate signal SCAN2 is generated as the gate on voltage VGL within an initialization period Ti initially allocated in one horizontal period 1H and then is remained at the gate off voltage VGH for the remaining frame period. The third gate signal EM is generated as the gate-off voltage VGH in synchronization with the second gate signal SCAN2 in the initialization period Ti within one horizontal period 1H and then is inverted as the gate on voltage VGL. The third gate signal EM is generated as the gate off voltage VGH during the sampling period Ts and the programming period Tw and is then inverted as the gate on voltage VGL. The third gate signal EM is maintained at the gate on voltage VGL during the remaining frame period, i.e., an emission period Tem after one horizontal period 1H, or may be inverted between the gate on voltage VGL and the gate off voltage VGH depending on a duty ratio of pulse width modulation (PWM) set in advance for duty driving of sub-pixels.

The first TFT M1 is a switching element which supplies the data voltage Vdata to the first node n1 in response to the first gate signal SCAN1. The first TFT M1 includes a gate connected to the first gate line GL1, a first electrode connected to the data line DL1, and a second electrode connected to the first node n1.

The second TFT M2 is a switching element for switching a current flowing in the OLED EL in response to the third gate signal EM. A gate of the second TFT M2 is connected to the third gate line GL3. A first electrode of the second TFT M2 is connected to the first power line PL1 to which the pixel driving voltage VDD is supplied. A second electrode of the second TFT M2 is connected to the second node n2.

The third TFT M3 supplies an initializing voltage VINI to the third node n3 in response to the second gate signal SCAN2. The third TFT M3 includes a gate connected to the second gate line GL2, a first electrode connected to the third node n3, and a second electrode connected to the second power line PL2.

The fourth TFT DT is a driving element for adjusting a current Ioled flowing in the OLED EL depending on a gate-source voltage Vgs. The fourth TFT DT includes a gate connected to the first node n1, a first electrode connected to the second node n2, and a second electrode connected to the third node n3.

The sub-pixels operate in the initialization period Ti, the sampling period Ts, the programming period Tw, and the emission period Tem for one horizontal period 1H, sample a threshold voltage of the fourth TFT DT, which is a driving element, and compensate a data voltage Vdata input in a current frame period by the threshold voltage.

At a start of the initialization period Ti, the first gate signal SCAN1 is generated at the gate high voltage VGH and the second gate signal SCAN2 is generated at the gate low voltage VGL. At the same time, the third gate signal EM is generated as VGH and then inverted as VGL. During the initialization period Ti, the second TFT M2 is turned off to cut off the current path of the OLED. The first and third TFTs M1 and M3 are turned on during the initialization period Ti. During the initialization period Ti, a predetermined reference voltage Vref is supplied to the data line DL1. During the initialization period Ti, a voltage of the first node n1 is initialized to the reference voltage Vref and a voltage of the third node n3 is initialized to a predetermined initialization voltage VINI. After the initialization period Ti, the second gate signal SCAN2 is inverted as VGH and the third TFT M3 is turned off.

During the sampling period Ts, the first gate signal SCAN1 is maintained at VGH and the second gate signal SCAN2 is maintained at VGH. The third gate signal EM is inverted as VGH at the beginning of the sampling period Ts. During the sampling period Ts, the first TFT M1 remains on state. The second TFT M2 is turned off during the sampling period Ts. The third TFT M3 remains off state during the sampling period Ts. During the sampling period Ts, the reference voltage Vref is supplied to the data line DL1. During the sampling period Ts, the voltage of the first node n1 is maintained at the reference voltage Vref, while the voltages of the second and third nodes n2 and n3 are raised by a drain-source current of the fourth TFT DT. By such a source-follower circuit, the gate-source voltage Vgs of the fourth TFT DT is sampled as a threshold voltage Vth of the fourth TFT DT.

During the programming period Tw, the first TFT M1 maintains the on state and the remaining second and third TFTs M2 and M3 maintain the off state. The data voltage Vdata of the input image is supplied to the data line DL1 during the programming period Tw. The data voltage is supplied to the first node n1, and a result of voltage distribution between the capacitors Cst and Cvdd with respect to a voltage change (Vdata-Vref) of the first node n1 is reflected on the second node n2 so that the gate-source voltage Vgs of the fourth TFT DT is programmed. During the programming period Tw, the voltage of the first node n1 is the data voltage Vdata, and the voltage of the second node n2 becomes "Vref−Vth+C'*(Vdata−Vref)" by adding a voltage distribution result (C'*(Vdata−Vref)) between the capacitors Cst and Cvdd to the "Vref−Vth" set through the sampling period Ts. As a result, the gate-source voltage Vgs of the fourth TFT DT is programmed as "Vdata−2Vref+Vth−C'*(Vdata−Vref)" through the programming period Tw. Here, C' is Cst/(Cst+Cvdd).

When the emission period Tem starts, the first and third gate signals SCAN1 and EM are inverted as VGL, while the second gate signal SCAN2 is maintained at VGH. During the emission period Tem, the second TFT M2 maintains the on state to form a current path of the OLED. The first and third TFTs M1 and M3 remain the off state. The fourth TFT DT adjusts an amount of current of the OLED depending on the data voltage during the emission period Tem.

The current Ioled flowing in the OLED during the emission period Tem is expressed by Equation 1. The OLED emits light by this current to express a brightness of the input image.

$$Ioled = \frac{k}{2}[(1 - C')(Vdata - Vref)]^2 \quad \text{[Equation 1]}$$

Here, k is a proportional constant determined by a mobility, a parasitic capacitance, a channel capacity of the fourth TFT DT.

Since Vth is included in the programmed Vgs through the programming period Tw, Vth is erased from bled. Therefore, the threshold voltage Vth of the driving element, that is, the fourth TFT DT, does not affect the current Ioled of the OLED.

FIG. 6 is a diagram schematically illustrating an example in which a second GIP circuit 300 is composed of two GIP circuits sharing a start pulse.

Figure 12:
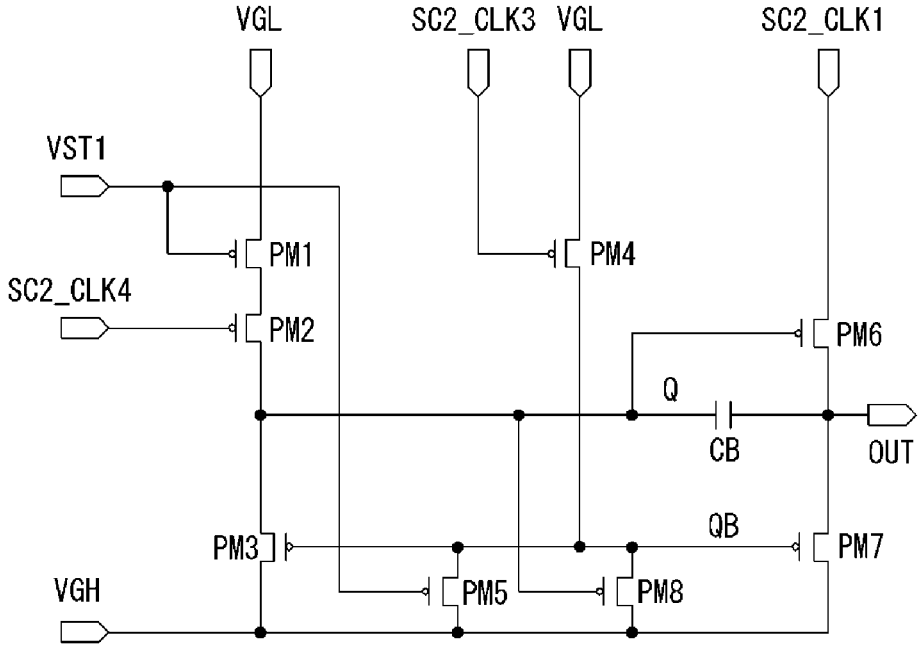
FIG. 12 is a circuit diagram illustrating a first GIP circuit according to an embodiment of the invention.

Referring to FIG. 6, a first GIP circuit 200 is composed of a shift register that receives a first start pulse VST1 and a shift clock CLK (SCAN2) and sequentially outputs a second gate signal SCAN2. Transistors of the first GIP circuit 200 may be implemented as p-type TFTs as shown in FIG. 12.

The second GIP circuit 300 includes a second-1 GIP circuit 310 and a second-2 GIP circuit 320 sharing a second start pulse VST2. The second-1 GIP circuit 310 is composed of a shift register that receives the second start pulse VST2 and a shift clock CLK (SCAN1) and sequentially outputs a first gate signal SCAN1. The second-2 GIP circuit 320 is composed of a shift register that receives the second start pulse VST2 and a shift clock CLK (EM) and sequentially outputs a third gate signal EM.

Figure 13:
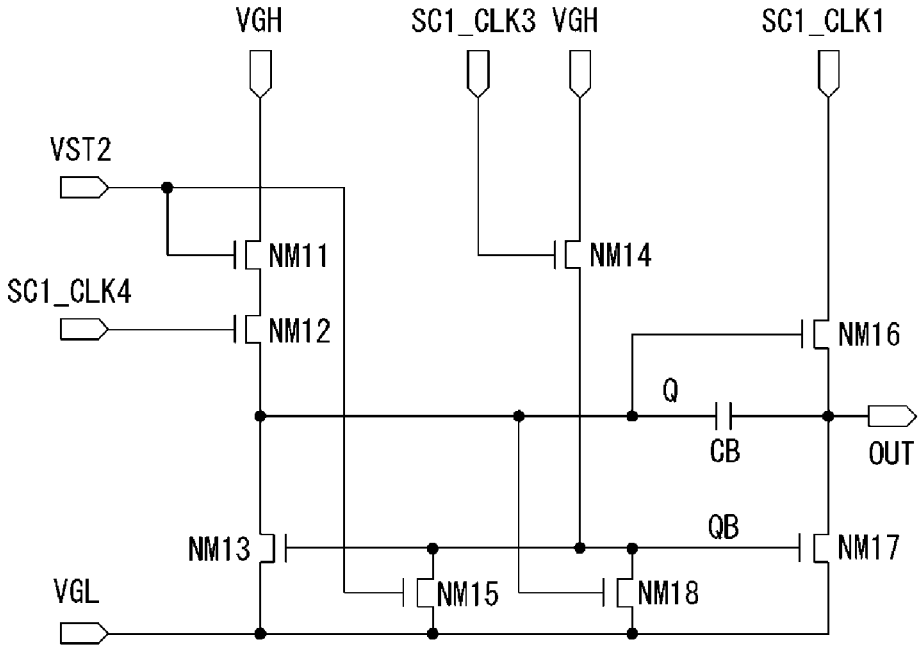
FIG. 13 is a circuit diagram illustrating a second-1 GIP circuit according to an embodiment of the invention.
Figure 14:
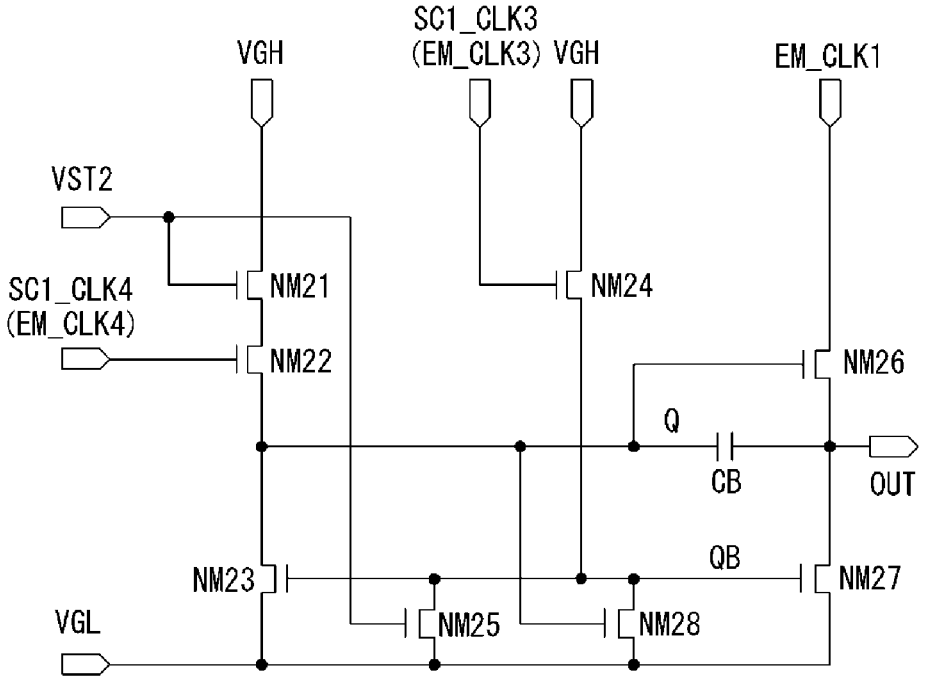
FIG. 14 is a circuit diagram illustrating a second-2 GIP circuit according to an embodiment of the invention.

As shown in FIG. 5, the first gate signal SCAN1 and the third gate signal EM have a slightly different waveform at the middle portion. However, the first gate signal SCAN1 and the third gate signal EM are generated in the same phase with the same initial rising timing within one horizontal period. As a result, the second start pulse VST2 may be shared in the second-1 and second-2 GIP circuits 310 and 320. Further, as shown in FIGS. 13 and 14, since the start pulse VST2 and shift clocks SC1_CLK3 and SC1_CLK4 can be shared in the second-1 and second-2 GIP circuits 310 and 320, the number of wirings in a bezel area can be reduced. Therefore, the invention can reduce a size of the bezel area in which GIP circuits are arranged in the display panel 100.

Figure 7:
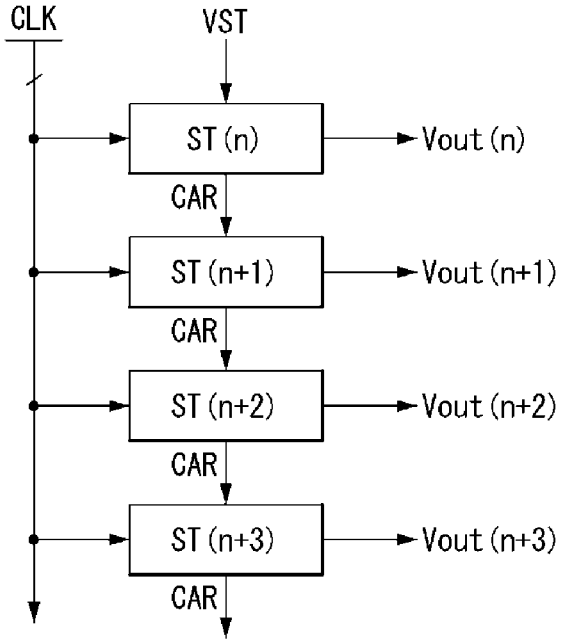
FIG. 7 is a diagram schematically illustrating a shift register circuit configuration in GIP circuits according to an embodiment of the invention.
Figure 8:
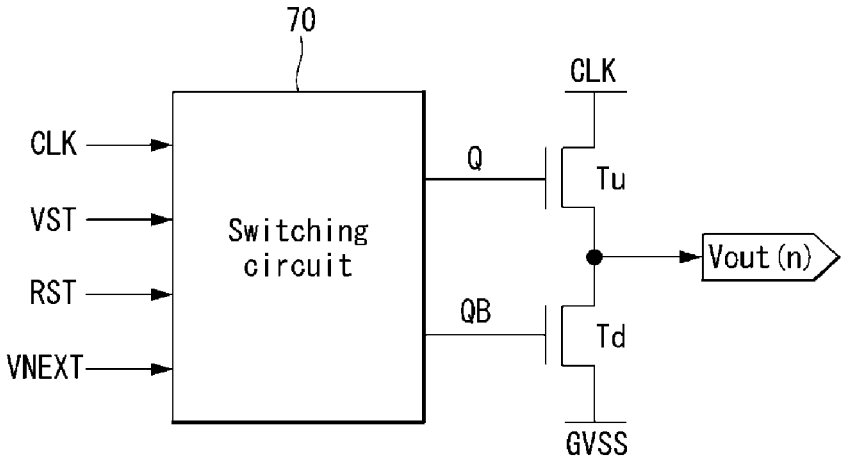
FIG. 8 is a circuit diagram illustrating an n-th stage for generating an n-th output in a shift register shown in FIG. 7.

FIG. 7 is a diagram schematically illustrating a shift register circuit configuration in GIP circuits 200, 310, and 320. FIG. 8 is a circuit diagram illustrating an n-th stage for generating an n-th output in a shift register shown in FIG. 7.

Referring to FIGS. 7 and 8, each of the GIP circuits 200, 310, and 320 shifts output voltages in a timing of the shift clock CLK using a plurality of stages ST (n) to ST (n+3) connected in a cascade connection via a carry signal line.

Each of the stages ST (n) to ST (n+3) receives a start pulse or a carry signal CAR received from a previous stage as a start pulse, and generates an output when a shift clock is input.

Each of the stages ST (n) to ST (n+3) includes a pull-up transistor Tu which charges an output node in response to a Q node voltage to increase the output voltages Vout (n) to Vout (n+3), a pull-down transistor Td which discharges the output node in response to a QB node voltage to decrease the output voltages, and a switching circuit 70 for charging and discharging the Q node and the QB node. The output nodes of each of the stages are connected to the gate lines of the display panel.

The pull-up transistor Tu charges the output node when the shift clock CLK is input in a state that the Q node is pre-charged. When the shift clock CLK is input to the pull-up transistor Tu, a voltage of the Q node floated through a parasitic capacitance of the pull-up transistor Tu rises more than the pre-charged voltage by bootstrapping, so that the pull-up transistor Tu is turned on. The gate signals SCAN1, SCAN2 and EM may be generated as a waveform of the shift clock CLK applied to the pull-up transistor Tu. The pull-down transistor Td connects the output node to a node to which the gate off voltage is applied when a QB node is charged to discharge the output voltage to the gate off voltage.

The switching circuit 70 charges the Q node in response to the start pulse VST input through a VST terminal or the carry signal received from the previous stage, and discharges the Q node in response to a signal received through a RST terminal or a VNEXT terminal. A reset signal for simultaneously discharging Q nodes of all the stages ST (n−1), ST (n), and ST (n+1) is applied to the RST terminal. A carry signal generated from a next stage is applied to the VNEXT terminal to discharge the Q node.

Figure 9:
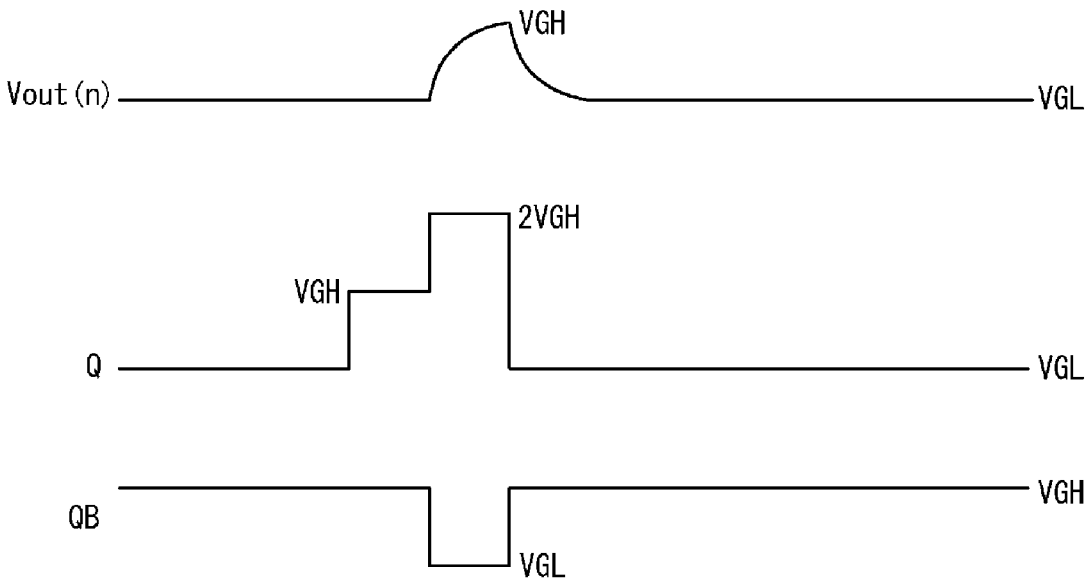
FIG. 9 is a waveform diagram illustrating a Q node voltage, a QB node voltage, and an output voltage of an n-th stage in second GIP circuits implemented as n-type TFTs according to an embodiment of the invention.

FIG. 9 is a waveform diagram illustrating a Q node voltage, a QB node voltage, and an output voltage Vout (n) of an n-th stage in second GIP circuits 310 and 320 implemented as n-type TFTs. The waveform of FIG. 9 is inverted in phase in the instance of the first GIP circuit 200 implemented as p-type TFTs.

Figure 10:
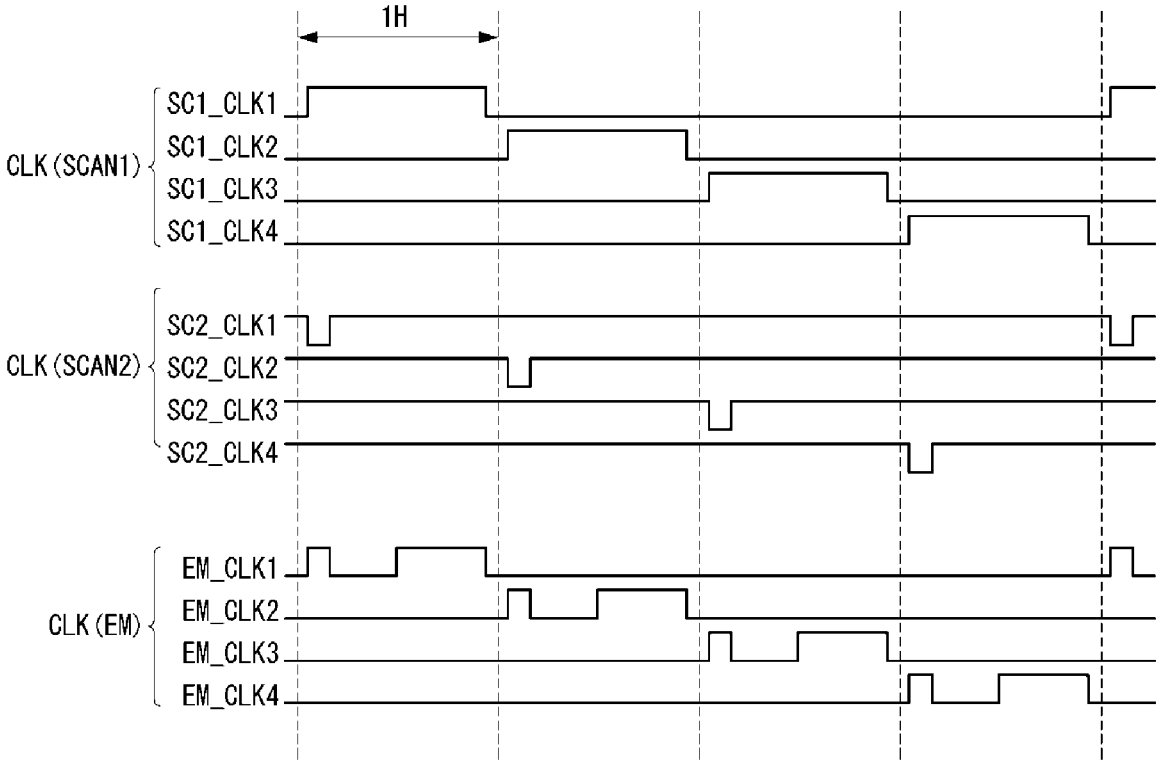
FIG. 10 is a waveform diagram illustrating shift clocks applied to GIP circuits according to an embodiment of the invention.

FIG. 10 is a waveform diagram illustrating a shift clock applied to the GIP circuits 200, 310, and 320.

Referring to FIG. 10, a first shift clock CLK (SCAN2) includes four-phase clock signals SC2_CLK1 to SC2_CLK4, which are generated in the same waveform as the waveform of the second gate signal SCAN2 and sequentially shifted. The first shift clock CLK (SCAN2) is supplied to the first GIP circuit 200.

A second-1 shift clock CLK (SCAN1) includes four-phase clock signals SC1_CLK1 to SC1_SCL4, which are generated in the same waveform as the waveform of the first gate signal SCAN1 and are sequentially shifted. The second-1 shift clock CLK (SCAN1) is supplied to the second-1 GIP circuit 310.

A second-2 shift clock CLK (EM) includes four-phase clock signals EM_CLK1 to EM_CLK4, which are generated in the same waveform as the waveform of the third gate signal EM and sequentially shifted. The second-2 shift clock CLK (EM) is supplied to the second-2 GIP circuit 320.

The second-1 shift clock CLK (SCAN1) and the second-2 shift clock CLK (EM) have the same phase by being synchronized in phase with each other in the initial rising timing and the last falling timing in one horizontal period 1H. Therefore, shift clocks other than shift clocks applied to the pull-up transistors in the GIP circuit are shared in the second-1 GIP circuit 310 and the second-2 GIP circuit 320.

The shift clocks CLK (SCAN1), CLK (SCAN2), and CLK (EM) are not limited to four-phase clocks. For example, the shift clocks may be generated as a two-phase clock, a six-phase clock, or an eight-phase clock depending on overlap period and pulse width of the gate signal.

Figure 11:
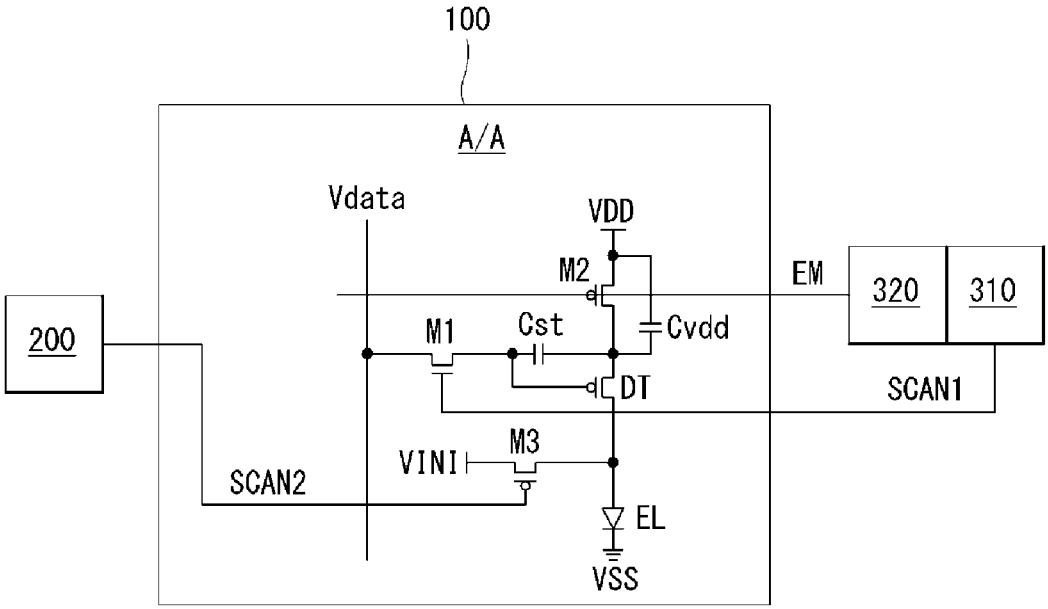
FIG. 11 is a circuit diagram illustrating a connection relationship between a pixel circuit and GIP circuits according to an embodiment of the invention.

FIG. 11 is a circuit diagram illustrating an example of a connection relationship between a pixel circuit and GIP circuits according to an embodiment of the invention.

Referring to FIG. 11, the first GIP circuit 200 supplies the gate signal SCAN2 to the p-type TFT M3 of the pixel circuit using a plurality of p-type TFTs. The first GIP circuit 200 receives the first start pulse VST1 and the shift clock CLK (SCAN2) and outputs the second gate signal SCAN2. The second gate signal SCAN2 is supplied to the sub-pixels through the second gate line GL2.

The second-1 GIP circuit 310 supplies the gate signal SCAN1 to the n-type TFT M1 of the pixel circuit using a plurality of n-type TFTs. The second-2 GIP circuit 320 supplies a different gate signal EM to the p-type TFT M2 of the pixel circuit using a plurality of n-type TFTs.

The second-1 GIP circuit 310 receives the second start pulse VST2 and the shift clock CLK (SCAN1) and outputs the first gate signal SCAN1. The first gate signal SCANT is supplied to the sub-pixels through the first gate line GL1. The second-2 GIP circuit 320 receives the second start pulse VST2 and the shift clock CLK (EM) and outputs the third gate signal EM. The third gate signal EM is supplied to the sub-pixels through the third gate line GL3.

The GIP circuits 200, 310, and 320 may be implemented as circuits as shown in FIGS. 12 to 14, but are not limited thereto.

FIG. 12 is a circuit diagram illustrating an example of the first GIP circuit 200.

Referring to FIG. 12, the first GIP circuit 200 is composed of p-type TFTs. An n-th stage of the first GIP circuit 200 includes a pull-up transistor PM6 for charging an output node in response to a Q node voltage and charging an output voltage OUT to a gate on voltage VGL, a pull-down transistor PM7 for adjusting the output voltage OUT to a gate off voltage VGH in response to a QB node voltage, and a switching circuit for charging and discharging the Q node and the QB node. The output voltage OUT is supplied to the second gate line GL2 as the second gate signal SCAN2 and is also transmitted to the other stage as a carry signal CAR. The switching circuit includes a plurality of TFTs PM1 to PM5 and PM8. The n-th stage of the first GIP circuit 200 includes a VGL node to which the VGL is supplied, a VGH node to which the VGH is supplied, CLK nodes to which shift clocks SC2_CLK1, SC2_CLK3, and SC2_CLK4 are input, and a VST node to which a first start pulse VST1 or a carry signal of a previous stage is input.

A first TFT PM1 and a second TFT PM2 supply the VGL to the Q node in response to a signal input through the VST node and a first CLK node, thereby precharging the Q node to the VGL. The first and second TFTs PM1 and PM2 are turned on when a gate voltage is the VGL to precharge the Q node. The first CLK node receives the shift clock SC2_CLK4 synchronized with a precharging timing of the Q node. The first TFT PM1 includes a gate connected to the VST node, a first electrode connected to the VGL node, and a second electrode connected to the second TFT PM2. The second TFT PM2 includes a gate connected to the first CLK node, a first electrode connected to the first TFT PM1, and a second electrode connected to the Q node.

A third TFT PM3 charges and discharges the Q node in response to the QB node voltage. The third TFT PM3 is turned on when the QB node voltage is the VGL. The third TFT PM3 includes a gate connected to the QB node, a first electrode connected to the Q node, and a second electrode connected to the VGH node.

A fourth TFT PM4 is turned on in response to the VGL of the shift clock SC2_CLK3 input through a second CLK node to supply the VGL to the QB node to precharge the QB node. The fourth TFT PM4 includes a gate connected to the second CLK node, a first electrode connected to the VGL node, and a second electrode connected to the QB node.

A fifth TFT PM5 is turned on in response to the VGL of a signal input through the VST node to connect the QB node to the VGH node to adjust a voltage of the QB node to the VGH. The fifth TFT PM5 includes a gate connected to the VST node, a first electrode connected to the QB node, and a second electrode connected to the VGH node.

A sixth TFT PM6 is a pull-up transistor that is turned on when the shift clock SC2_CLK1 is input through a third CLK node to adjust a voltage of the output node to the VGL. When the sixth TFT PM6 is turned on, a voltage of the second gate line GL2 connected to the output node changes into the gate on voltage VGL. When the shift clock SC2_CLK1 is input to the sixth TFT PM6 with the VGL voltage in a state that the Q node is precharged to the VGL, a voltage of the Q node rises to 2VGL by bootstrapping and the sixth TFT PM6 is turned on. The sixth TFT PM6 includes a gate connected to the Q node, a first electrode connected to the third CLK node, and a second electrode connected to the output node.

A seventh TFT PM7 is turned on in response to the VGL of the QB node to connect the output node to the VGH node to adjust a voltage of the second gate line GL2 to the gate off voltage VGH. The seventh TFT PM7 includes a gate connected to the QB node, a first electrode connected to the output node, and a second electrode connected to the VGH node.

FIG. 13 is a circuit diagram illustrating an example of a second-1 GIP circuit 310. FIG. 14 is a circuit diagram illustrating an example of a second-2 GIP circuit 320. As shown in FIGS. 13 and 14, the second-1 and second-2 GIP circuits 310 and 320 may be implemented as the same circuit, but are not limited thereto.

Referring to FIG. 13, the second-1 GIP circuit 310 is composed of n-type TFTs. An n-th stage of the second-1 GIP circuit 310 includes a pull-up transistor NM16 for charging an output node in response to a Q node voltage and charging the output voltage OUT to a gate on voltage VGH, a pull-down transistor NM17 for lowering the output voltage OUT to a gate off voltage VGL in response to a QB node voltage, and a switching circuit for charging and discharging the Q node and the QB node. The switching circuit includes a plurality of TFTs NM11 to NM15, NM18. The output voltage OUT is supplied to the first gate line GL1 as the first gate signal SCAN1 and transmitted as a carry signal CAR to the other stage.

The n-th stage of the second-1 GIP circuit 310 includes a VGL node to which the VGL is supplied, a VGH node to which the VGH is supplied, CLK nodes to which shift clocks SC1_CLK1, SC1_CLK3, and SC1_CLK4 are input, and a VST node to which a second start pulse VST2 or a carry signal of a previous stage is input.

A first TFT NM11 and a second TFT NM12 supply the VGH to the Q node in response to a signal input through the VST node and a first CLK node, thereby precharging the Q node to the VGH. The first and second TFTs NM11 and NM12 are turned on when a gate voltage is the VGH to precharge the Q node. The first CLK node receives the shift clock SC1_CLK4 synchronized with a precharging timing of the Q node. The first TFT NM11 includes a gate connected to the VST node, a first electrode connected to the VGH node, and a second electrode connected to the second TFT NM12. The second TFT NM12 includes a gate connected to the first CLK node, a first electrode connected to the first TFT NM11, and a second electrode connected to the Q node.

A third TFT NM13 charges and discharges the Q node in response to the QB node voltage. The third TFT NM13 is turned on when the QB node voltage is the VGH. The third TFT NM13 includes a gate connected to the QB node, a first electrode connected to the Q node, and a second electrode connected to the VGL node.

A fourth TFT NM14 is turned on in response to the VGH of the shift clock SC1_CLK3 input through a second CLK node to supply the VGH to the QB node to precharge the QB node. The fourth TFT NM14 includes a gate connected to the second CLK node, a first electrode connected to the VGH node, and a second electrode connected to the QB node.

A fifth TFT NM15 is turned on in response to the VGH of a signal input through the VST node to connect the QB node to the VGL node to discharge a voltage of the Q node to the VGL. The fifth TFT NM15 includes a gate connected to the VST node, a first electrode connected to the QB node, and a second electrode connected to the VGL node.

A sixth TFT NM16 is a pull-up transistor that is turned on when the shift clock SC1_CLK1 is input through a third CLK node to raise a voltage of the output node to the VGH. When the sixth TFT NM16 is turned on, a voltage of the first gate line GL1 connected to the output node changes into the gate on voltage VGH. When the shift clock SC1_CLK1 is input to the sixth TFT NM16 with the VGH voltage in a state that the Q node is precharged to the VGH, a voltage of the Q node rises to 2VGH by bootstrapping and the sixth TFT NM16 is turned on. The sixth TFT NM16 includes a gate connected to the Q node, a first electrode connected to the third CLK node, and a second electrode connected to the output node.

A seventh TFT NM17 is turned on in response to the VGH of the QB node to connect the output node to the VGL node to lower a voltage of the first gate line GL1 to the gate off voltage VGL. The seventh TFT NM17 includes a gate connected to the QB node, a first electrode connected to the output node, and a second electrode connected to the VGL node.

Referring to FIG. 14, the second-2 GIP circuit 320 is composed of n-type TFTs. An n-th stage of the second-2 GIP circuit 320 includes a pull-up transistor NM26 for charging an output node in response to a Q node voltage and charging the output voltage OUT to a gate on voltage VGH, a pull-down transistor NM27 for lowering the output voltage OUT to a gate off voltage VGL in response to a QB node voltage, and a switching circuit for charging and discharging the Q node and the QB node. The switching circuit includes a plurality of TFTs NM21 to NM25, NM28. The output voltage OUT is supplied to the third gate line GL3 as the third gate signal EM and transmitted as a carry signal CAR to the other stage.

The n-th stage of the second-2 GIP circuit 320 includes a VGL node to which the VGL is supplied, a VGH node to which the VGH is supplied, CLK nodes to which shift clocks EM_CLK1, EM_CLK3, and EM_CLK4 are input, and a VST node to which a second start pulse VST2 or a carry signal of a previous stage is input.

Figure 15:
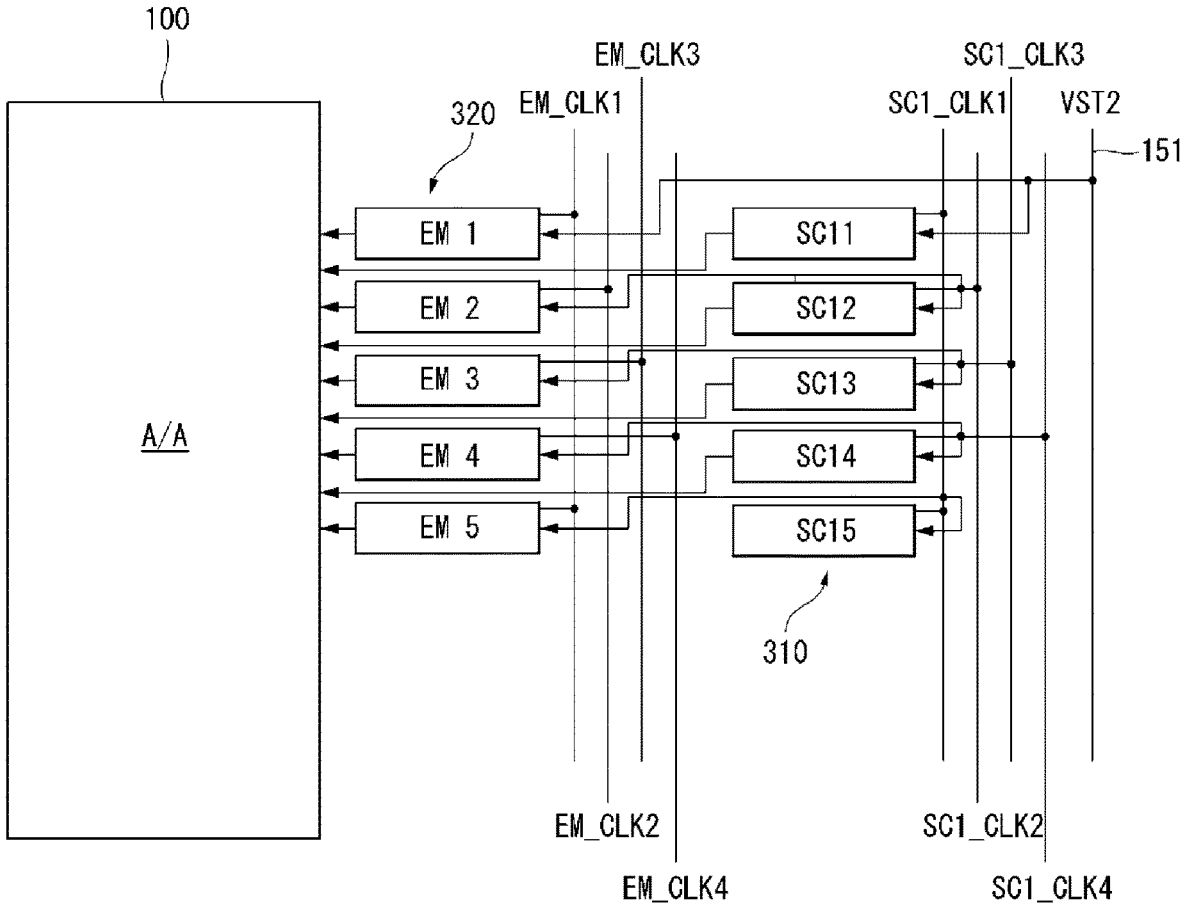
FIG. 15 is a diagram illustrating VST wiring and CLK wirings connected to the second GIP circuit according to an embodiment of the invention.

Phases of signals output from the second-1 and second-2 GIP circuits 310 and 320 are the same and phases of the shift clocks CLK (SCAN1) and CLK (EM) are the same. Therefore, a start pulse VST of the second-1 and second-2 GIP circuits 310 and 320 is shared, as shown in FIG. 15, so that the number of VST wirings 151 can be reduced and the number of output pins of the timing controller 120 can be reduced.

The second-1 shift clock CLK (SCAN1) and the second-2 shift clock CLK (EM) have the same phase in one horizontal period 1H. The shift clocks applied to the first and second CLK nodes of the second-1 and second-2 GIP circuits 310 and 320 may be shared. For example, as shown in FIGS. 13 and 14, the shift clocks applied to the first and second CLK nodes of the second-2 GIP circuit 320 are applied as SC1_CLK3 and SC1_CLK4, so that the second-2 GIP circuit 320 may share shift clocks with the second-1 GIP circuit 310.

A first TFT NM21 and a second TFT NM22 supply the VGH to the Q node in response to a signal input through the VST node and a first CLK node, thereby precharging the Q node to the VGH. The first and second TFTs NM21 and NM22 are turned on when a gate voltage is the VGH to precharge the Q node. The first CLK node receives the shift clock EM_CLK4 or SC1_CLK4 synchronized with a precharging timing of the Q node. The first TFT NM21 includes a gate connected to the VST node, a first electrode connected to the VGH node, and a second electrode connected to the second TFT NM22. The second TFT NM22 includes a gate connected to the first CLK node, a first electrode connected to the first TFT NM21, and a second electrode connected to the Q node.

A third TFT NM23 charges and discharges the Q node in response to the QB node voltage. The third TFT NM23 is turned on when the QB node voltage is the VGH. The third TFT NM23 includes a gate connected to the QB node, a first electrode connected to the Q node, and a second electrode connected to the VGL node.

A fourth TFT NM24 is turned on in response to the VGH of the shift clock EM_CLK3 or SC1_CLK3 input through a second CLK node to supply the VGH to the QB node to precharge the QB node. The fourth TFT NM24 includes a gate connected to the second CLK node, a first electrode connected to the VGH node, and a second electrode connected to the QB node.

A fifth TFT NM25 is turned on in response to the VGH of a signal input through the VST node to connect the QB node to the VGL node to discharge a voltage of the Q node to the VGL. The fifth TFT NM25 includes a gate connected to the VST node, a first electrode connected to the QB node, and a second electrode connected to the VGL node.

A sixth TFT NM26 is a pull-up transistor that is turned on when the shift clock EM_CLK1 is input through a third CLK node to raise a voltage of the output node to the VGH. When the sixth TFT NM26 is turned on, a voltage of the third gate line GL3 connected to the output node changes into the gate on voltage VGH. When the shift clock EM_CLK1 is input to the sixth TFT NM26 with the VGH voltage in a state that the Q node is precharged to the VGH, a voltage of the Q node rises to 2VGH by bootstrapping and the sixth TFT NM26 is turned on. The sixth TFT NM26 includes a gate connected to the Q node, a first electrode connected to the third CLK node, and a second electrode connected to the output node.

A seventh TFT NM27 is turned on in response to the VGH of the QB node to connect the output node to the VGL node to lower a voltage of the third gate line GL3 to the gate off voltage VGL. The seventh TFT NM27 includes a gate connected to the QB node, a first electrode connected to the output node, and a second electrode connected to the VGL node.

In FIGS. 12 to 14, the output nodes of the GIP circuits 200, 310, and 320 are illustrated as one, but may be separated into a gate signal output node and a carry signal output node. In this instance, a pull-up transistor connected to the Q node is added. Also, in order to reduce the DC gate bias stress of the pull-down transistors, the QB nodes may be separated and the QB nodes may be alternately driven by alternating current (AC) by connecting pull-down transistors to each of the QB nodes.

FIG. 15 is a diagram illustrating VST wiring 151 and CLK wirings connected to a second GIP circuit. In FIG. 15, "SC11" to "SC15" show a stage connection structure of the second-1 GIP circuit 310. Further "EM 1" to "EM 5" shows a stage connection structure of the second-2 GIP circuit 320.

Figure 16:
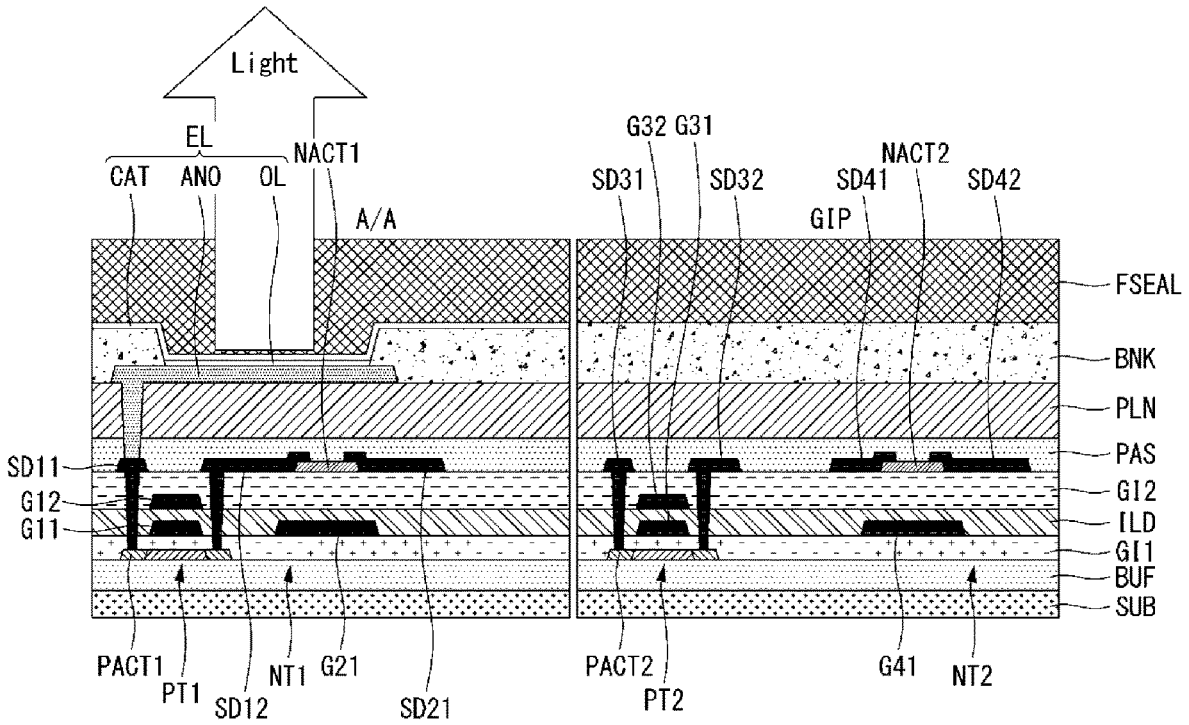
FIGS. 16 and 17 are views illustrating a cross-sectional structure of TFTs in a TFT array substrate of a display panel according to an embodiment of the invention.
Figure 17:
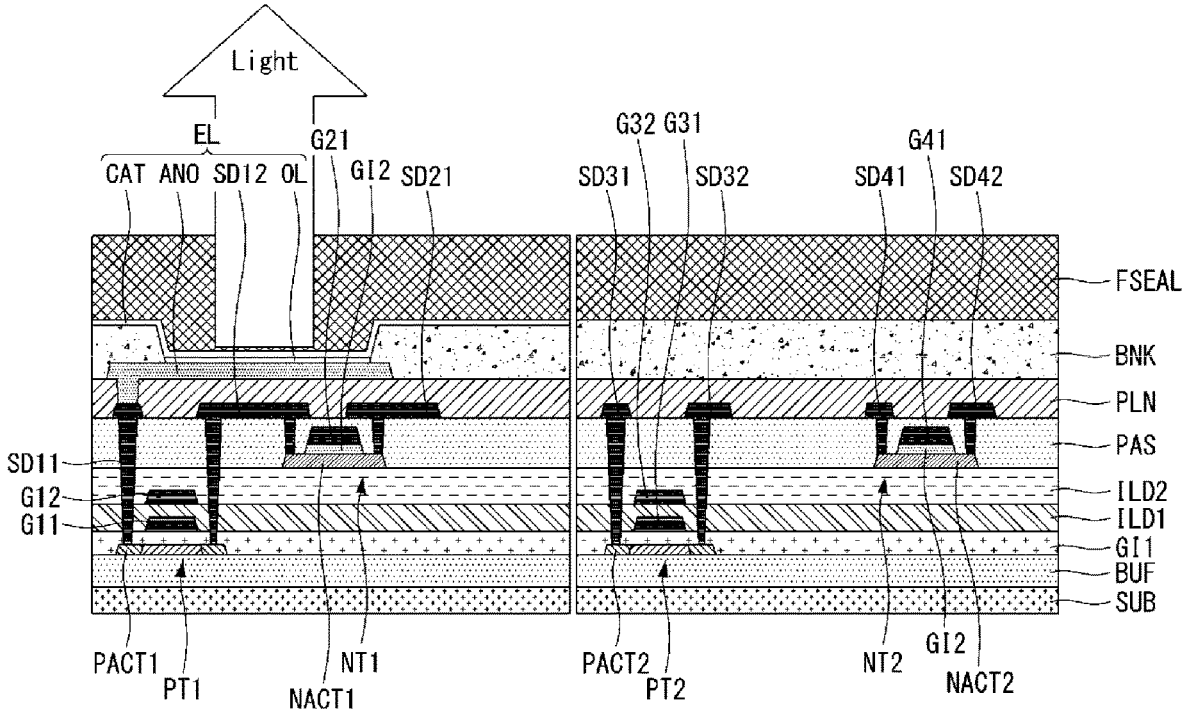

FIGS. 16 and 17 are views illustrating a cross-sectional structure of TFTs in a TFT array substrate of a display panel 100 according to an embodiment of the invention.

Referring to FIG. 16, sub-pixels of an active area A/A include a p-type TFT PT1 and an n-type TFT NT1. The first GIP circuit 200 is composed of a p-type TFT PT2 and the second GIP circuits 310 and 320 are composed of an n-type TFT NT2. The LTPS TFT may be implemented as a p-type TFT (PT1, PT2) of a top-gate structure. The oxide TFT may be implemented as an n-type TFT (NT1, NT2) of a bottom-gate structure.

A buffer layer BUF is formed on an entire surface of a substrate SUB. The buffer layer BUF may be omitted. A light shielding layer may be selectively formed only at a necessary portion between the buffer layer BUF and the substrate SUB. The light shielding layer may be formed for the purpose of preventing external light from entering a semiconductor layer of a TFT disposed thereon.

First semiconductor patterns PACT1 and PACT2 are formed on the buffer layer BUF. The first semiconductor pattern PACT1 and PACT2 include channel regions of the p-type TFTs PT1 and PT2. The channel region is defined as overlapping region of a gate of the TFT and the semiconductor pattern. Impurities are doped into both sides of the first semiconductor patterns PACT1 and PACT2 to change into a p-type semiconductor region. A source or a drain of the TFTs PT1 and PT2 is connected to the p-type semiconductor region.

A first gate insulating layer GI1 is formed on the buffer layer BUF so as to cover the first semiconductor patterns PACT1 and PACT2. First gate metal patterns G11, G21, G31 and G41 are formed on the first gate insulating layer GI1. The first gate metal patterns G11, G21, G31 and G41 include gates of the p-type TFTs PT1 and PT2 and the n-type TFTs NT1 and NT2.

An interlayer insulating layer ILD is formed on the first gate insulating layer GI1 so as to cover the first gate metal patterns G11, G21, G31, and G41. Second gate metal patterns G12 and G32 are formed on the interlayer insulating layer ILD. Capacitor are formed between the gate metal patterns G11-G12 and G31-G32 overlapped with the interlayer insulating layer ILD interposed therebetween.

A second gate insulating layer GI2 is formed on the interlayer insulating layer ILD so as to cover the second gate metal patterns G12 and G32. Second semiconductor patterns NACT1 and NACT2 and source-drain metal patterns SD11, SD12, SD21, SD31, SD32, SD41 and SD42 are formed on the second gate insulating layer GI2. The second semiconductor patterns NACT1 and NACT2 define channel regions of the n-type TFTs NT1 and NT2. The source-drain metal patterns SD11, SD12, SD31, and SD32 are connected to the first semiconductor patterns PACT1 and PACT2 of the p-type TFTs PT1 and PT2 through contact holes passing through the insulating layers GI1, ILD and GI2. The source-drain metal patterns SD11, SD12, SD21, SD31, SD32, SD41 and SD42 include the source and drain of the p-type TFTs PT1 and PT2 and the n-type TFTs NT1 and NT2. In addition, the source-drain metal patterns SD12, SD21, SD41, and SD42 are in contact with impurity-doped both side of n-type semiconductor regions in the second semiconductor patterns NACT1 and NACT2.

A passivation layer PAS is formed on the second gate insulating layer GI2 so as to cover the second semiconductor patterns NACT1 and NACT2 and the source-drain metal patterns SD11, SD12, SD21, SD31, SD32, SD41, and SD42. A planarization layer PLN is formed on the passivation layer PAS. An anode ANO of an OLED is connected to the p-type TFT PT1 through a contact hole passing through the planarization layer PLN and the passivation layer PAS.

A bank pattern BNK is formed on the planarization layer PLN to define an OLED light emitting region. An organic compound layer OL of the OLED is deposed on the OLED light emitting region and a cathode CAT is formed thereon. A face seal FSEAL is formed on a TFT array substrate so as to cover the cathode CAT to prevent moisture permeation so that the OLED is not exposed to moisture.

Referring to FIG. 17, sub-pixels of an active area A/A include a p-type TFT PT1 and an n-type TFT NT1. The first GIP circuit 200 is composed of a p-type TFT PT2 and the second GIP circuits 310 and 320 are composed of an n-type TFT NT2. In FIG. 17, the LTPS TFT may be implemented as a p-type TFT (PT1, PT2) of a top-gate structure. The oxide TFT may be implemented as an n-type TFT (NT1, NT2) of a bottom-gate structure. In this embodiment, gates G11 and G31 of the p-type TFTs PT1 and PT2 and gates G21 and G41 of the n-type TFTs NT1 and NT2 are separated with insulating layers ILD1 and ILD2 therebetween.

A buffer layer BUF is formed on an entire surface of a substrate SUB. The buffer layer BUF may be omitted. A light shielding layer may be selectively formed only at a necessary portion between the buffer layer BUF and the substrate SUB. The light shielding layer may be formed for the purpose of preventing external light from entering a semiconductor layer of a TFT disposed thereon.

First semiconductor patterns PACT1 and PACT2 are formed on the buffer layer BUF. The first semiconductor pattern PACT1 and PACT2 include channel regions of the p-type TFTs PT1 and PT2. Impurities are doped into both sides of the first semiconductor patterns PACT1 and PACT2 to change into a p-type semiconductor region. A source or a drain of the TFTs PT1 and PT2 is connected to the p-type semiconductor region.

A first gate insulating layer GI1 is formed on the buffer layer BUF so as to cover the first semiconductor patterns PACT1 and PACT2. First gate metal patterns G11 and G31 are formed on the first gate insulating layer GI1. The first gate metal patterns G11 and G31 include gates of the p-type TFTs PT1 and PT2.

A first interlayer insulating layer ILD1 is formed on the first gate insulating layer GI1 so as to cover the first gate metal patterns G11 and G31. Second gate metal patterns G12 and G32 are formed on the first interlayer insulating layer ILD1. Capacitor are formed between the gate metal patterns G11-G12 and G31-G32 overlapped with the first interlayer insulating layer ILD1 interposed therebetween.

A second interlayer insulating layer ILD2 is formed on the first interlayer insulating layer ILD1 so as to cover the second gate metal patterns G12 and G32. Second semiconductor patterns NACT1 and NACT2 are formed on the second interlayer insulating layer ILD2. The second semiconductor patterns NACT1 and NACT2 define channel regions of the n-type TFTs NT1 and NT2. Impurities are doped into both sides of the second semiconductor patterns NACT1 and NACT2 to change into an n-type semiconductor region. A second gate insulating layer pattern GI2 and third gate metal patterns G21 and G41 are stacked on the second semiconductor patterns NACT1 and NACT2. The third gate metal patterns G21 and G41 include gates of the n-type TFTs NT1 and NT2.

A passivation layer PAS is formed on the second interlayer insulating layer ILD2 so as to cover the second semiconductor patterns NACT1 and NACT2 and the third gate metal patterns G21 and G41. Source-drain metal patterns SD11, SD12, SD21, SD31, SD32, SD41 and SD42 are formed on the passivation layer PAS. The source-drain metal patterns SD11, SD12, SD31, and SD32 are connected to the first semiconductor patterns PACT1 and PACT2 of the p-type TFTs PT1 and PT2 through contact holes passing through the insulating layers GI1, ILD1, ILD2, and PAS. In addition, the source-drain metal patterns SD12, SD21, SD41, and SD42 are connected to the second semiconductor patterns NACT1 and NACT2 of the n-type TFTs NT1 and NT2 through contact holes passing through the passivation layer PAS. The source-drain metal patterns SD11, SD12, SD21, SD31, SD32, SD41 and SD42 include the source and drain of the p-type TFTs PT1 and PT2 and the n-type TFTs NT1 and NT2.

A planarization layer PLN is formed on the passivation layer PAS. An anode ANO of an OLED is connected to the p-type TFT PT1 through a contact hole passing through the planarization layer PLN.

A bank pattern BNK is formed on the planarization layer PLN to define an OLED light emitting region. An organic compound layer OL of the OLED is deposed on the OLED light emitting region and a cathode CAT is formed thereon. A face seal FSEAL is formed on a TFT array substrate so as to cover the cathode CAT to prevent moisture permeation so that the OLED is not exposed to moisture.

As described above, one or more embodiments of the invention generate a gate signal of an n-type TFT and a p-type TFT of a pixel circuit by using a GIP circuit composed of n-type TFTs. Therefore, the invention can minimize the size of the GIP circuit and the size of the bezel area in the display panel in which the n-type TFT and the p-type TFT are embedded in each of the pixels. Furthermore, since the start pulse and the shift clock can be shared between the GIP circuits, the invention can further reduce the GIP circuit and the bezel area.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display panel comprising:

pixels in which data lines and gate lines are crossed and which are arranged in a matrix form; and a gate driver configured to supply a gate pulse to the gate lines, wherein each pixel circuit of the pixels includes one or more n-type transistors and two or more p-type transistors, and wherein the gate driver includes:

a first gate driving circuit including a plurality of n-type transistors, and being configured to supply a first gate signal to an n-type transistor of the pixel circuit;

a second gate driving circuit including a plurality of p-type transistors, and being configured to supply a second gate signal to one of the p-type transistors of the pixel circuit; and a third gate driving circuit including a plurality of n-type transistors, and being configured to supply a third gate signal to another one of the p-type transistors of the pixel circuit, and wherein the display panel further comprises:

a timing controller which controls an operating timing of the gate driver by using a gate timing control signal; and a first level shifter connected to the first gate driving circuit and a second level shifter connected to the second and third gate driving circuits, wherein a voltage level of the gate timing control signal output from the timing controller is converted through the first and second level shifters and supplied to the first gate driving circuit and the second and third gate driving circuits respectively.

2. The display panel of claim 1, wherein each of the n-type transistors includes an oxide thin film transistor (TFT).

3. The display panel of claim 1, wherein each of the p-type transistors includes a low temperature polysilicon (LTPS) thin film transistor.

4. The display panel of claim 1, wherein each of the first, second and third gate driving circuits includes a shift register which receives a start pulse and shift clocks and shifts an output signal, and wherein the first and third gate driving circuits share a start pulse, or share a part of a start pulse and shift clocks.

5. The display panel of claim 4, wherein the shift clock controls a shift timing of the first gate signal, the second gate signal and the third gate signal.

6. The display panel of claim 4, wherein the shift register includes a plurality of stages, each of the stages includes a pull-up transistor which charges an output node in response to a Q node voltage to increase output voltages, a pull-down transistor which discharges the output node in response to a QB node voltage to decrease the output voltages, and a switching circuit for charging and discharging the Q node and the QB node, the output nodes of each of the stages are connected to the gate lines, and wherein the Q node is a connection node between the pull-up transistor and the switching circuit, and the QB node is a connection node between the pull-down transistor and the switching circuit.

7. The display panel of claim 1, wherein each pixel circuit further includes a light emitting element and a driving element, the n-type transistor supplied with the first gate signal is a switching element which supplies a data voltage to a first node in response to the first gate signal and includes a gate connected to a first gate line, a first electrode connected to the data line, and a second electrode connected to the first node; the p-type transistor supplied with the third gate signal is a switching element for switching a current flowing in the light emitting element in response to the third gate signal and includes a gate connected to a third gate line, a first electrode connected to a first power line to which a pixel driving voltage is supplied, and a second electrode connected to a second node; the p-type transistor supplied with the second gate signal is a switching element which supplies an initializing voltage to a third node in response to the second gate signal and includes a gate connected to a second gate line, a first electrode connected to the third node, and a second electrode connected to a second power line to which the pixel driving voltage is supplied, and wherein the first node, the second node and the third node are a gate, a first electrode and a second electrode of the driving element respectively.

8. An electroluminescence display comprising:

an active area including pixels in which data lines and gate lines are crossed and which are arranged in a matrix form;

a data driver configured to supply a data signal of an input image to the data lines; and a gate driver configured to supply a gate pulse to the gate lines, wherein each pixel circuit of the pixels includes one or more n-type transistors and two or more p-type transistors, and wherein the gate driver includes:

a first gate driving circuit comprised of a plurality of n-type transistors including an oxide semiconductor, and configured to supply a first gate signal to an n-type transistor of the pixel circuit;

a second gate driving circuit comprised of a plurality of p-type transistors including a polysilicon semiconductor, and configured to supply a second gate signal to one of the p-type transistors of the pixel circuit; and a third gate driving circuit comprised of a plurality of n-type transistors including an oxide semiconductor, and configured to supply a third gate signal to the other one of the p-type transistors of the pixel circuit, and wherein the electroluminescence display further comprises:

a timing controller which controls an operation timing of the data driver by using a data timing control signal and controls an operating timing of the gate driver by using a gate timing control signal; and a first level shifter connected to the first gate driving circuit and a second level shifter connected to the second and third gate driving circuits, wherein a voltage level of the gate timing control signal output from the timing controller is converted through the first and second level shifters and supplied to the first gate driving circuit and the second and third gate driving circuits respectively.

9. The electroluminescence display of claim 8, wherein each of the first, second and third gate driving circuits includes a shift register which receives a start pulse and shift clocks and shifts an output signal, and wherein the first and third gate driving circuits share a start pulse, or share a part of a start pulse and shift clocks.

10. The electroluminescence display of claim 9, wherein the shift register includes a plurality of stages, each of the stages includes a pull-up transistor which charges an output node in response to a Q node voltage to increase output voltages, a pull-down transistor which discharges the output node in response to a QB node voltage to decrease the output voltages, and a switching circuit for charging and discharging the Q node and the QB node, the output nodes of each of the stages are connected to the gate lines, and wherein the Q node is a connection node between the pull-up transistor and the switching circuit, and the QB node is a connection node between the pull-down transistor and the switching circuit.

11. The electroluminescence display of claim 8, wherein each pixel circuit further includes a light emitting element and a driving element, the n-type transistor supplied with the first gate signal is a switching element which supplies a data voltage to a first node in response to the first gate signal and includes a gate connected to a first gate line, a first electrode connected to the data line, and a second electrode connected to the first node; the p-type transistor supplied with the third gate signal is a switching element for switching a current flowing in the light emitting element in response to the third gate signal and includes a gate connected to a third gate line, a first electrode connected to a first power line to which a pixel driving voltage is supplied, and a second electrode connected to a second node; the p-type transistor supplied with the second gate signal is a switching element which supplies an initializing voltage to a third node in response to the second gate signal and includes a gate connected to a second gate line, a first electrode connected to the third node, and a second electrode connected to a second power line to which the pixel driving voltage is supplied, and wherein the first node, the second node and the third node are a gate, a first electrode and a second electrode of the driving element respectively.

12. The electroluminescence display of claim 8, wherein in a low refresh mode, each of the data driver and the gate driver has a driving frequency lowered under the control of the timing controller.

* * * * *